US006448538B1

(12) United States Patent
Miyata

(10) Patent No.: US 6,448,538 B1
(45) **Date of Patent: *Sep. 10, 2002**

(54) ELECTRIC HEATING ELEMENT

(76) Inventor: Seiichiro Miyata, 9-10 Chofunakadoihonmachi, Shimonoseki-shi, Yamaguchi 752-0964 (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,348

(22) PCT Filed: May 6, 1997

(86) PCT No.: PCT/JP97/01529

§ 371 (c)(1),
(2), (4) Date: May 17, 1999

(87) PCT Pub. No.: WO97/42891

PCT Pub. Date: Nov. 13, 1997

(30) Foreign Application Priority Data

| | | |
|---|---|---|
| May 5, 1996 | (JP) | 8-146408 |
| May 9, 1996 | (JP) | 8-152823 |
| May 20, 1996 | (JP) | 8-163577 |
| Jun. 29, 1996 | (JP) | 8-204088 |
| Sep. 8, 1996 | (JP) | 8-279832 |
| Mar. 8, 1997 | (JP) | 9-094330 |

(51) Int. Cl.[7] ..... H05B 3/68; H05B 3/16; H05B 3/10; H05B 1/06

(52) U.S. Cl. ..... 219/444.1; 219/543; 219/548; 252/506

(58) Field of Search ..... 219/443.1, 444.1, 219/461.1, 466.1, 467.1, 468.1, 543, 544, 546, 547; 118/724, 725, 726, 621; 252/500, 519.12, 506, 520.2, 507, 520.22, 509, 518.1

(56) References Cited

U.S. PATENT DOCUMENTS

| | | | | |
|---|---|---|---|---|
| 3,248,346 A | * | 4/1966 | Amberg et al. | 252/521.3 |
| 4,071,880 A | * | 1/1978 | Rutt | 361/309 |
| 4,357,526 A | * | 11/1982 | Yamamoto et al. | 219/544 |
| 4,486,651 A | * | 12/1984 | Atsumi et al. | 219/544 |
| 4,863,683 A | * | 9/1989 | Nakatani et al. | 419/10 |
| 4,882,203 A | * | 11/1989 | Witmer | 427/124 |
| 5,151,871 A | * | 9/1992 | Matsumura et al. | 219/444.1 |
| 5,233,166 A | * | 8/1993 | Maeda et al. | 219/544 |
| 5,280,156 A | * | 1/1994 | Niori et al. | 118/725 |
| 5,573,690 A | * | 11/1996 | Nobori et al. | 219/444.1 |
| 5,665,166 A | * | 9/1997 | Deguchi et al. | 118/725 |
| 5,787,578 A | * | 8/1998 | Faroq et al. | 29/843 |
| 5,851,298 A | * | 12/1998 | Ishii | 219/444.1 |
| 5,904,872 A | * | 5/1999 | Arami et al. | 219/444.1 |
| 5,998,049 A | * | 12/1999 | Tanaka et al. | 428/697 |

* cited by examiner

*Primary Examiner*—Sang Paik
(74) *Attorney, Agent, or Firm*—Marshall, Gerstein & Borun

(57) ABSTRACT

An electric heating element formed on an insulating ceramic substance includes and electrically heat-generating material film having a microstructure composed of a silicide alone, a mixture of silicide and Si, or Si along fused to the surface of sintered nitride or carbide ceramic insulating substrate. A heating mechanism is coupled with the bottom face of an electrostatically chucking mechanism provided with a dielectric ceramic and electrodes formed on the bottom face of face of the heating mechanism. The heating mechanism has a fusable electric-heating material film between two ceramic insulting substrates having the same or nearly the same coefficients of thermal expansion. The films is fused to the substrates.

10 Claims, 12 Drawing Sheets

ELECTRIC HEATING ELEMENT

TECHNICAL FIELD

The present invention relates to an electric heating element and, more particularly, to an electric heating element having a structure comprising a ceramic insulating substrate and an electrically heat-generating material film, said film being fused to the surface of said electric insulating ceramic substrate.

The present invention also relates to a structure of an electrostatic chuck and, more particularly, to a structure of an electrostatic chuck capable of quickly and precisely controlling the temperature of an electrically chucked material to be treated, such as a semiconductor substrate.

TECHNICAL BACKGROUND

In the field of electric heating elements, it is known that a planar heating element having less temperature variation can be obtained by forming a heater circuit on a ceramic plate having high thermal conductivity. Such a heater, referred to as a ceramic heater, is required to have the following characteristics.

(1) High adhesion strength between the circuit and the ceramic material (2) Heater circuit material having high oxidation resistance and applicability at high temperatures (3) High heat generation density of the heater, namely a high value of resistance of the heater circuit. Most importantly, possibility of production of large heaters with a low cost.

However, there are only the following two types available at present.

(1) A heater comprising a circuit made of an electric-heating metal and a previously sintered ceramic plate, said circuit being baked on said ceramic plate.

This type has such a structure that a circuit pattern is formed by sintering a paste made by mixing glass into a powder of a noble metal such as platinum, platinum alloy or silver. This type has the following drawbacks.

(1) This type is limited to the type wherein the circuit pattern is baked only on one side of the ceramic substrate (single-side baking). Because the surface with the circuit formed thereon is exposed, it is necessary to insulate this portion depending on the application.

(2) Adhesion strength of the electric-heating circuit is low and tends to peel off.

(3) Maximum operating temperature is limited to the melting point of glass used as the binder, with the operating temperatures 400 to 500 C. at most, and operation at a high temperatures above 1000 C. is prohibited.

(2) A heater made by integrally baking an electric-heating circuit at the same time when the ceramic substrate is sintered.

This type has a structure obtained by printing a circuit pattern of a powder paste of a metal having high melting point such as tungsten on a green sheet of a ceramic substrate, laminating another green sheet on the printed circuit and integrally sintering them under pressure. The resultant structure is a structure wherein an electric-heating circuit is incorporated between the ceramic plates (double-side baking).

Although this structure eliminates the drawback of the type (1) , namely exposure of the electric-heating circuit, there arise the following problems.

(1) Because the circuit must be covered by the ceramic, the circuit cannot be formed near the peripheral edge of the element, resulting in lower temperatures near the edges. Thus, it is difficult to achieve uniform temperature distribution.

(2) This type of thin planar shape is subject to a warp during sintering. Pressurized sintering is required to obtain a heater element without warp.

This method essentially involves the problem of deformation taking place during sintering of the ceramic material, and it is difficult to obtain a large-sized sintered article without deformation. A three-dimensional structure cannot be produced. This method requires it to use a die, leading to extremely high costs when producing articles in a small lot.

(3) Electric-heating metals are limited to high melting point metals such as tungsten and molybdenum, which do not melt at the sintering temperature of the ceramic. Tungsten and molybdenum have a drawback of tendency to oxidize, and the ceramic material that encloses the electric-heating circuit is required to be free of defects and completely air-tight. It is difficult to use in the air atmosphere at a high temperature over a long period of time. Tungsten and molybdenum have another problem that the electric resistance and heat generation density of these metals are low. The ceramic heater has such problems as described above.

Meanwhile, it is well known that suicides represented by molybdenum disilicide ($MoSi_2$) have very high oxidation resistance and can be used in electrical heating operation at high temperatures in the air atmosphere.

Largest drawback of the silicide heat-generating material is that it is very brittle. Because of the brittleness, silicide is usually mixed with glass powder and the mixture is sintered to form a plate or rod having greater mechanical strength. However, use of glass as a binder gives rise to a problem with regard to the heat resistance. Also silicide itself has an intrinsic problem of softening at high temperatures, causing the heater element to deform and droop.

In the field of electrostatic chucks, on the other hand, plasma processing of semiconductors is required to be more minute and have higher accuracy as the scale of circuit integration increases.

In order to achieve extreme miniaturization and higher accuracy of plasma processing, the temperature of plasma processing is a very important factor. In the producing facilities in use at present, however, silicon wafers to be processed are only cooled to prevent overheat (etching process) and accordingly film forming process (CVD) is carried out at a lower temperature leaving the temperature rise during the process without intervention.

The present situation is as described above, which does not mean that the importance of temperature control is not recognized, but because there is no method available for controlling the temperature economically at a desired rate. Although precise temperature control is possible in a laboratory without economical considerations in terms of productivity, there is no method of quick and precise temperature control applicable to production lines, capable of quickly setting an optimum temperature for individual film material to be processed without decreasing the productivity.

Solving the problems described above requires a method of quickly regulating the temperature according to the speed of the production process. Namely, it is necessary to quickly and continuously regulating the temperature without decreasing the production speed.

Besides the plasma processing, there are such demands as quickly heating up to a predetermined temperature and quickly cooling down after heating, in order to increase the rate of operation of the facilities.

Such demands also call for quickly and continuously regulating the temperature.

In the case of a vacuum processing, on the other hand, moisture is adhered on the surface of the object to be treated. In order to quickly attain the desired vacuum degree, the object may be heated but there is no method of quickly heating only the object.

Under these circumstances, the present invention has been made for solving the above problems and an object is to provide an electric heating element having a novel structure which: 1) can be applied to either double-side baking type or single-side baking type of the electric-heating circuit by using a ceramic material which has previously been sintered as the substrate, 2) can solve the problem of deformation of the ceramic during sintering without requiring pressurization, 3) assures high adhesion strength between the circuit and the ceramic, 4) has excellent oxidation resistance and can be used in the air atmosphere at a high temperature, 5) allows it to produce large-sized articles or those having three-dimensional structures, and 6) has a high electrical resistance and a high wattage density.

The present invention also provides an electrostatic chuck having a novel structure capable of adsorbing and fixing semiconductor substrates and other objects to be treated, and quickly and precisely controlling the temperature to a predetermined level by quickly heating up or cooling down.

DISCLOSURE OF THE INVENTION

The above problems of the electric heater element can be solved by the following means. That is, the electric heating element of the present invention is characterized by having a structure comprising an electric insulating nitride or carbide ceramic substrate and an electrically heat-generating material film having a microstructure composed of a silicide alone, a mixture of a silicide and Si, or Si alone, said film being fused to the surface of said electric insulating ceramic substrate.

Also, the electric heating element of the present invention is characterized by having a structure comprising electrically heat-generating material film which is fused on an electric insulating ceramic substrate, the film containing an active metal in the amount of not less than 0.5% on the surface and an having a microstructure composed of a silicide alone or a mixture of a silicide and Si, said film being fused to the surface of said electric insulating ceramic substrate.

In the construction of the above electric heating element, it is preferred that the ceramic substrate is an aluminum nitride ceramic and the electrically heat-generating material has a microstructure composed of a mixture of silicide and Si.

It is also preferred that the ceramic substrate is a silicon nitride ceramic and the electrically heat-generating material has a microstructure composed of a mixture of a silicide and Si.

It is also preferred that the ceramic substrate is a silicon carbide ceramic and the electrically heat-generating material has a microstructure composed of a mixture of a silicide and Si.

In the construction wherein the electric insulating ceramic substrate having a film thereon which contains an active metal in the amount of not less than 0.5% on the surface, the ceramic substrate is preferably an oxide ceramic.

It is also preferred that the oxide ceramic is an alumina ceramic and the electrically heat-generating material has a microstructure composed of a silicide.

The above problems about the electrostatic chuck can be solved by an electrostatic chuck having the following structure.

That is, the electrostatic chuck of the present invention is characterized by:

1. having a structure comprising an electrostatically chucking mechanism provided with a dielectric ceramic and electrodes formed on the bottom face of said ceramic, and a heating mechanism coupled with the bottom face of said electrostatically chucking mechanism, said heating mechanism having a structure comprising two electric insulating ceramic substrates having the same or nearly the same linear expansion coefficients and a fusable electric-heating material film interposed between said substrates, said film being fused to said two substrates; and 2. having a structure comprising an electrostatically chucking mechanism provided with a dielectric ceramic and electrodes formed on the bottom face of said ceramic, a heating mechanism coupled with the bottom face of said electrostatically chucking mechanism, and a cooling mechanism coupled with the bottom face of said heating mechanism, said heating mechanism having a structure comprising two electric insulating ceramic substrates having the same or nearly the same linear expansion coefficients and a fusable electric-heating material film interposed between said substrates, said film being fused to said two substrates.

In the above constructions, 3. two ceramic substrates of the dielectric ceramic and the heating mechanism are respectively an aluminum nitride ceramic; and 4. the electric-heating material is a metal having a microstructure composed of a mixture of silicide and Si.

BEST MODE FOR CARRYING OUT THE INVENTION

Figure 1:
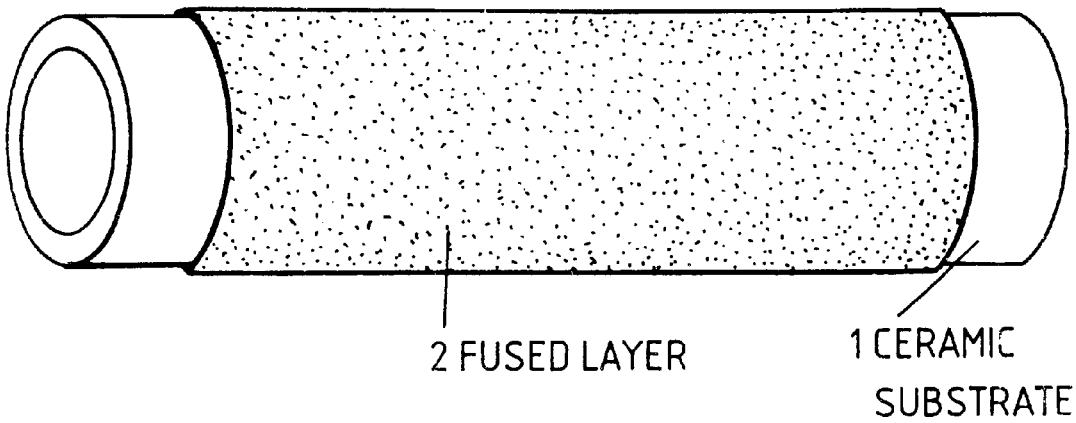
FIG. 1 is a schematic drawing for explaining one embodiment of an electric heating element of the present invention.

The electric heating element of the present invention will be described below.

Typical examples of the nitride and carbide electric insulating ceramics are aluminum nitride ceramic, silicon nitride ceramic and silicon carbide ceramic. The nitride and carbide electric insulating ceramics of the present invention include aluminum nitride ceramic alone, silicon nitride ceramic alone and silicon carbide ceramic alone, and composite ceramics of these ceramic and other nitrides, carbides, borides and oxides.

Among these nitride and carbide ceramics, aluminum nitride, silicon carbide and composite ceramics of these ceramic materials have excellent thermal conductivity, and are therefore most preferably used as a substrate for an electric heating element.

In case of a double-side baking type electric heating element comprising two ceramics as the substrates and an electrically heat-generating material film, which is interposed and fused between two ceramics, two ceramic substrates may not necessarily be made of the same ceramic material but preferably have near equal values of linear expansion coefficient.

Except for elements that form a homogeneous solid solution with Si, e.g. Ge, almost all of metals react with Si to form silicides.

Assuming an element X reacts with Si to form a silicide, the microscopic structure of X-Si alloy changes as described below with the change in Si content.

(1) As the Si content increases gradually, a first silicide is formed at a certain composition. Let this composition be Si(1). In the region of composition where Si<Si(1), a silicide phase of metal X is mixed in the matrix of metal X, or a silicide phase of metal X is mixed in the matrix of metal X which contains some of Si incorporated therein.

(2) As the Si content increases over that of Si (1), silicides of different compositions appear successively. With Si contents greater than a certain composition Si (2), an eutectic of silicide and Si is formed. Si (1) is the silicide most rich in element X, and Si (2) is the silicide most rich in Si content. Composition in a region Si (1)<= Si<=Si (2) is one kind of silicide or two or more silicides mixed.

(3) Composition in the region of Si content over Si(2) below 100% Si, namely Si(2)<Si<Si(100%), Si and silicide coexist.

(4) When the composition is 100% Si, the material becomes polycrystal of Si.

Even when a third element, a fourth element, a fifth element, and so on are added to the two-element system of X and Si, such a basic skeleton of the material that silicide is included in the matrix remains unchanged. That is, at least the silicide (or composite silicide) does not disappear from the matrix while either the third element, the fourth element, the fifth element, and so on are incorporated into the matrix, incorporated into the silicide to form a composite silicide, or form other compound thereby to crystallize or precipitate in the matrix.

In this specification, the term silicide is used to mean pure silicide and composite silicide collectively.

Compositions of a part of the region (1) (Si>=5%) and in the regions of (2), (3) and (4), when molten, wet nitride and carbide ceramics and fused thereto.

For the electric heating element, the composition of the fusible region of (1) (Si>=5%) and in the regions of (2), (3) and (4)can be used. The compositions of the regions of (2), (3) and (4) are particularly preferable.

The compositions of (2), (3) and (4) have the following advantages in addition to the fusibility with the electric insulating nitride and carbide ceramics.

1. Linear expansion coefficient is within the range from 4 to $8\times10^{-6}$ (4 to $6\times10^{-6}$ for the compositions of (3) and (4), especially) which can be controlled by changing the silicide content, thereby to achieve matching with the ceramic material of the substrate. Therefore, a thermal stress in the fused interface is minimized and stability at high temperatures is good enough to prevent peel-off of the heater element. The range of the compositions of (3) and (4) have an advantage of lower melting points and hence lower fusing temperatures. Although silicide has such a drawback for the use as a heater element as the tendency to soften and deform at high temperatures (about 1000 C. or higher), fusing with a ceramic material prevents deformation and causes the stress at the interface of fusing to be relieved, thus turning the drawback into an advantage. Thus it can be said that silicide or a metallic material including silicide is very preferably used as a film to be fused with a ceramic material for making a heater element used at high temperatures.

2. High oxidation resistance in air atmosphere at high temperatures (above 1000 C.) . The compositions of (2), (3) and (4) have higher oxidation resistance in air atmosphere at high temperatures than the compositions of (1).
3. High electrical resistance makes shorter resistor circuit possible, so that a heater having higher wattage per unit area can be made.

For the reasons described above, the electric heating element is preferably made from the compositions of (2), (3) and (4) rather than the region of (1), and the compositions of (3) and (4) are particularly preferable.

Because the composition of (1) has higher thermal expansion coefficient and lower electrical resistance, thinner film is necessary in order to decrease the thermal stress and increase the electrical resistance. The film thickness is preferably 20 micro meter or less and most preferably 10 micro meter or less. Fused film thicker than 20 micro meter tends to peel off.

For the element X in the X-Si alloy, Cr, Mo, W, Fe, Ni, Co, B, P and active metal, and Pt, Pd, Rh, Ir, Cu, Ag and other silicide forming elements may be selected depending on the application. One or more of these elements may be mixed as required. Adding two or more elements, for example, is effective in achieving silicide of finer microstructure.

While the quantity added may be determined freely within such a range as the compositions of (2) and (3) can form a microstructure, namely in the range of forming silicide, and in a range of forming silicide and Si, the most preferable range is the range where the compositions of (3) form a microstructure, namely the range where silicide and Si coexist. The range of (3) is advantageous in that the linear expansion coefficient and electrical resistance can be controlled by changing the composition of silicide in the microstructure and the melting point is low enough to fuse with the ceramic material at a lower temperature.

Based on the above discussion, what is particularly preferable among the elements listed above are active metals.

Elements other than the above may also be added as far as it does not change the microstructure. For example, such elements which are solid-solubilized into Si to decrease the electrical resistance or which penetrates into silicide to change the characteristics (electrical resistance, linear expansion coefficient, melting point, etc.) of the silicide may be added as required.

In the manufacture of impurity semiconductors, a trace amount (in the order of ppm or ppb) of metals having three or five valences are added to high-purity Si in order to make p-type semiconductor or n-type semiconductor, which is effective also in the case of the present invention. That is, the technique of adding a trace amount of element having three or five valences to Si which constitutes a part of microstructure thereby to change the electrical resistance is also effective in controlling the electrical resistance of the fused film in the present invention. The electrical resistance can also be effectively decreased by using an Si material used in casting which includes trace elements (Fe, P, Al, C, etc.) in the Si material. It is also effective, as a matter of course, to add small amounts of elements having three or five valences such as B, Al and P or other elements to high-purity silicon material thereby to control the electrical resistance. Both B and P are solid-solubilized into Si in a trace amount and also form silicide.

Although Si is intrinsically a semiconductor and has a very high resistance, trace elements added thereto as impurities significantly increase the conductivity of Si, and therefore Si material including trace elements such as those described above is rather preferable. Good examples of the elements which infiltrate into silicide and change the characteristics (electrical resistance, linear expansion coefficient, melting point, etc.) of the silicide include Al which infiltrates $MOSi_2$ to form composite silicide $(MO_5Al_3)Si_2$. In this case, melting point of $MOSi_2$ decreases from 2060 C. to 1800 C.

Ge, an element having properties similar to those of Si, does not form a silicide with Si and is capable of forming a homogeneous solid solution at any ratio, and can be added as required thereby to effectively control the melting point and/or electrical resistance.

Because an active element is an element capable of accelerating wettability ceramics and diffusion V, Nb, Ta, Ti, Zr, Hf, Y, Mn, Ca, Mg and other rare earth elements, aluminum and other elements are referred to as active elements in the present invention.

When an active element is added to Si, wettability is significantly increased with wetting angle decreasing. As a result, it makes it possible to decrease the thickness of the fused film, thus having a significant effect of increasing the electrical resistance. It also improves strength of adherence by fusing.

Although effect of improving the wettability can be obtained by adding an active element to a concentration as low as 0.1%, adding 0.5% or more is preferable in order to obtain practical effect.

In a binary alloy of Si and an active metal, increasing the content of the active metal decreases the relative content of Si. In case resistance against oxidation in the air atmosphere is required, Si content is preferably 3% or higher, and most preferably in the region of (2) and (3), namely the region of silicide or higher.

In the case of a Si—Ti alloy, for example, a silicide having a composition of $Tl_3Si$ is formed near a Ti contents of 84%, and a silicide having a composition of $TiSi_2$ is formed near a Ti content of 46%. When Ti content is below 46%, namely when Si content is higher than 54%, eutectic crystal of $TiSi_2$ and Si is obtained. Therefore, Ti content is higher than 84% up to 100% in the region of (1), Ti content is from 46to 84% in the region of (2), and Ti content is from 0.5% up to below 46% in the region of (3). Thus the upper limit of Ti content is about 84% for the binary alloy of Si and Ti with the resistance against oxidation in the air atmosphere taken into consideration. The upper limit changes when a third and a fourth and more elements are added, as a matter of course. Si may also be replaced with Cr or other oxidation resistant element.

A composition where Si and an active metal coexist can fuse with oxide ceramics in general other than the nitride and carbide ceramics, Consequently an oxide ceramic material can be used for the substrate.

Such kinds of the oxide ceramic that have proper linear expansion coefficients can be selected to match the linear expansion coefficient of the metal to be fused with. Oxides having a linear expansion coefficient in a range from about 3 to $9\times10^{-6}$ can be selected.

When alumina, zirconia, chromia or the like is used as the substrate, composition of the silicide (2) is most preferable for the fused metal. Linear expansion coefficients of silicides are generally in a range from 5 to $9\times10^{-6,}$ among which one having linear expansion coefficient near to that of the substrate ceramic can be selected thereby matching the linear expansion coefficient.

To mainly adjust the electrical resistance, powders or fibers of ceramic materials of electric heating elements (SiC, $ZrO_2$, etc.) or other insulating ceramic materials, which are insoluble in the fusable material, powders or fibers of intermetallic compounds of electric heating elements such as silicide, boride or the like having a high melting point, or powders or fibers of metals having a high melting point may optionally be mixed with the fusable materials. Alternatively, these powders or fibers of the ceramic material of the electric heating element may be bonded by using the fusable material as a binder and fused to the ceramic substrate at the same time.

The fusable material may also be used as a brazing metal to bond a heat generating resistor in a form of foil, plate or wire made of ceramic, metal or intermetallic compound to the ceramic substrate.

When a metal foil is used, for example, problem of the oxidation resistance of W or Mo can be eliminated by interposing the metal foil of W, Mo or the like between two ceramic substrates and brazing the whole surface with the brazing material.

The film fused to the ceramic substrate is preferably thinner. The thinner the film, the higher the electrical resistance and therefore the shorter the heater circuit can be made. This also decreases the thermal stress in the interface of fusing, thereby making use over a longer period of time at a higher temperature possible. Thickness of the fused film is preferably in a range from several micrometers to 500 micrometers.

The resistive heat generating film of the present invention can be applied to either single-side fusing type wherein the film is fused to one side of a ceramic substrate or to double-side fusing type wherein the film is fused to two ceramic substrates which interpose the film.

In the double-side fusing type, such a problem can occur that molten metal penetrates into a space between the circuit, resulting in short-circuiting.

This problem can be prevented effectively by keeping a space greater than the thickness of the fused metal film disposed between the circuits, between the two ceramic substrates.

Specifically, it is effective to form a groove between the circuits beforehand and then laminating and fusing them.

Fusing of the resistive heat generating film is carried out by coating the fusing surface of the ceramic substrate with metallic powder prepared in specified composition, or sticking a metal foil prepared in the specified composition and having the circuit pattern, and then heating, melting and fusing it. Alternatively, such a process may also be employed as the film of metal to be fused is formed by spray coating, sputtering, PVD, CVD or other film forming technique, then the film is heated to be melted and fused. Also such a process may be employed as, after forming a film of a part of the components, powder of other elements is applied or metal foil is attached which is then molted and fused. Air atmosphere of fusing is preferably vacuum, reducing or inert air atmosphere.

When the single-side fusing type wherein the resistive heat generation film is fused to one side of a ceramic substrate and double-side fusing type wherein the film is fused to two ceramic substrates interposing the film are compared, the double-side fusing type is better in terms of uniformity of film thickness, flatness and evenly fusing performance of the resistive heat generating film. With the single-side fusing type, the ceramic substrate may deform after fusing in case the ceramic substrate and the resistive heat generating film have different values of linear expansion coefficient. Also the surface of the ceramic substrate may deform during heating. However, when the resistive heat generating film is interposed between two ceramic substrates having the same or substantially the same values of linear expansion coefficient and fused, deformation does not occur during heating or after fusing even when the resistive heat generating film and the ceramic substrate have somewhat different values of linear expansion coefficient. Thus the double-side fused structure is more preferable in order to achieve uniform heating and uniform temperature distribution.

The double-side fused structure is also very preferable with regards to corrosion resistance and oxidation resistance, because only the edge face of the fused film which can be seen through the gap between the ceramic substrates is exposed to the outside. And the exposed edge which corresponds to the thickness can be protected from the outside by covering with a ceramic film by means of the sol-gel method, filling the gap with an inorganic adhesive agent, sealing with glass or sealing the circumference of the ceramic substrates with a fusing metal.

The fusing temperature must be at least higher than the solidus line temperature at which molten portion appears, and most preferably the liquidus line temperature or higher.

The Si material of the fused metal may be selected from a range of Si materials from those used in semiconductor manufacture to those used for the adjustment of composition in metal casting.

Si materials used in casting include trace elements such as Fe, C, P, Al and the like which improve the electrical conductivity of Si, and are preferable for the purpose of the present invention. Si with impurities used for semiconductors (p-type semiconductor, n-type semiconductor) is also preferable for the purpose of the present invention.

Figure 2:
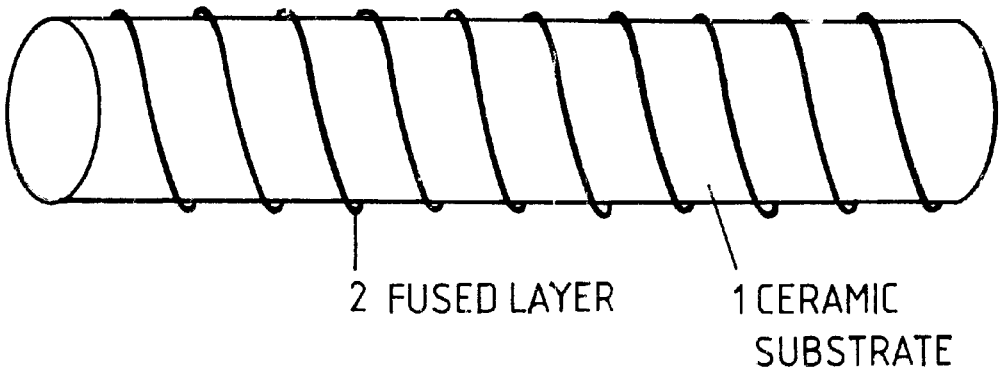
FIG. 2 is a schematic drawing for explaining another embodiment of the electric heating element of the present invention.
Figure 3:
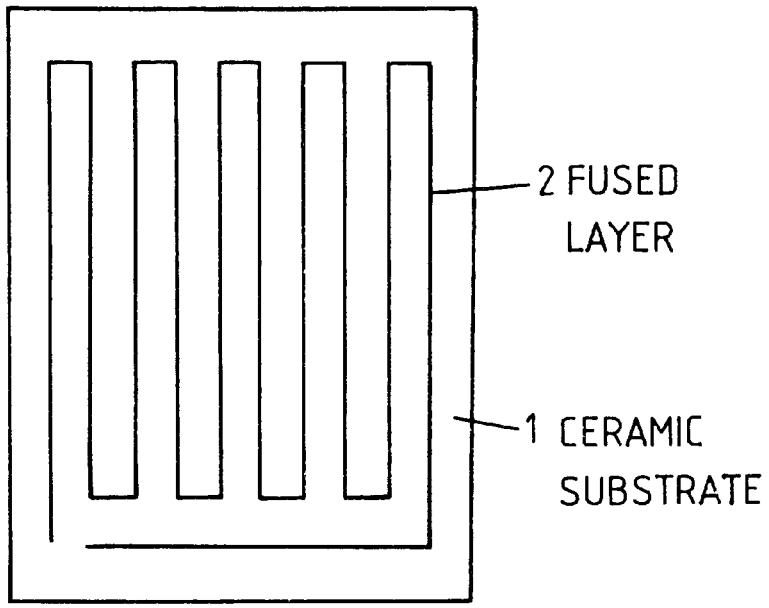
FIG. 3 is a schematic drawing for explaining still another embodiment of an electric heating element of the present invention.

Now the structure of the present invention will be described below with reference to the accompanying drawings. FIGS. 1 to 3 are schematic drawings for explaining embodiments of a single-side fused structure of the present invention. FIG. 1 is a schematic drawing for explaining a structure wherein a film of silicide, silicide+Si, or Si is fused to the entire surface of a pipe-shaped ceramic substrate. FIG. 2 is a schematic drawing for explaining a structure wherein a film of silicide, silicide+Si, or Si is fused spirally to the surface of a round rod made of ceramic. FIG. 3 is a schematic drawing for explaining a structure wherein a film with a circuit pattern is fused to a plate-shaped ceramic substrate.

In FIG. 1, numeral 1 denotes a substrate made in a pipe of aluminum nitride, silicon nitride, alumina, chromia or the like. Numeral 2 denotes a film of silicide, silicide+Si, or Si fused to the substrate.

Both ends of the fused layer are connected to conductors which are connected to an external power source by mechanical or metallurgical means.

FIG. 2 shows an example wherein a spiral fused film is formed on a substrate of round rod shape. FIG. 3 shows an example wherein a fused film having the circuit pattern is formed on a plate-shaped substrate. These patterns may be formed either by coating powder of fused metal in the pattern and fusing the powder, or by covering the entire surface with the fused film and then removing unnecessary portions through etching, blasting or other means thereby to have the desired pattern left to remain.

Figure 5:
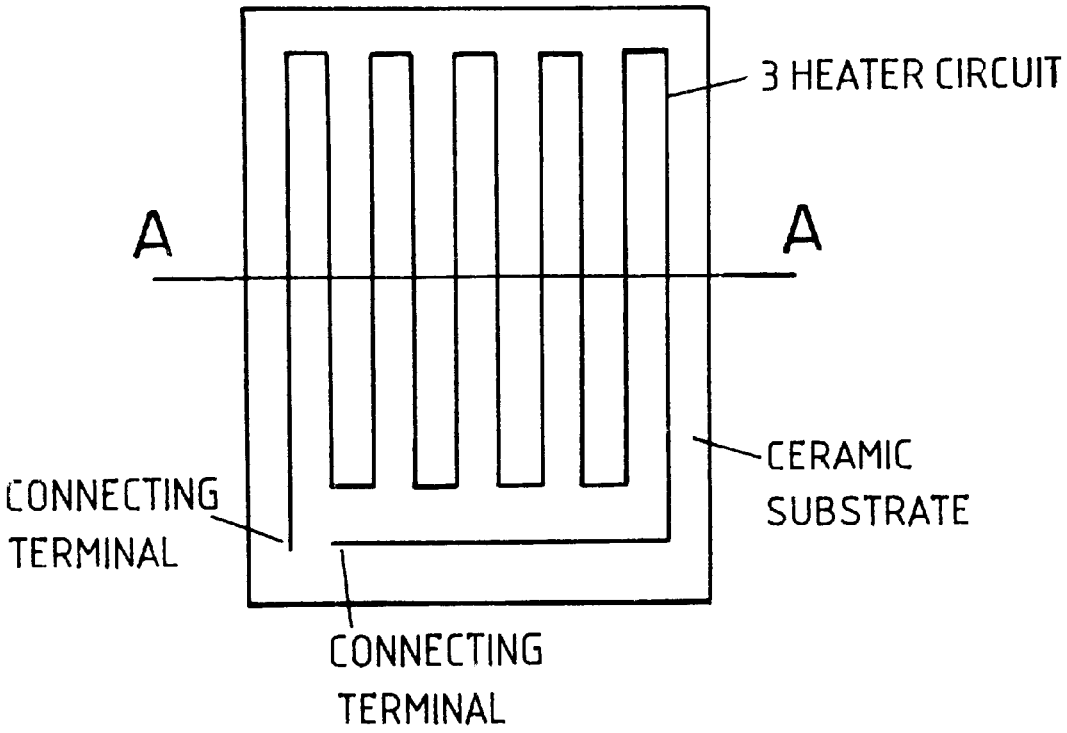
FIG. 5 is a schematic drawing showing one example of a heater circuit of a fused metal of the electric heating element of the present invention.

FIGS. 5 to 16 show embodiments of a double-side fused structure of the present invention. FIG. 5 shows one example of the heater circuit of the fused metal. The heater circuit is interposed between two ceramic substrates and fused thereto.

Figure 6:
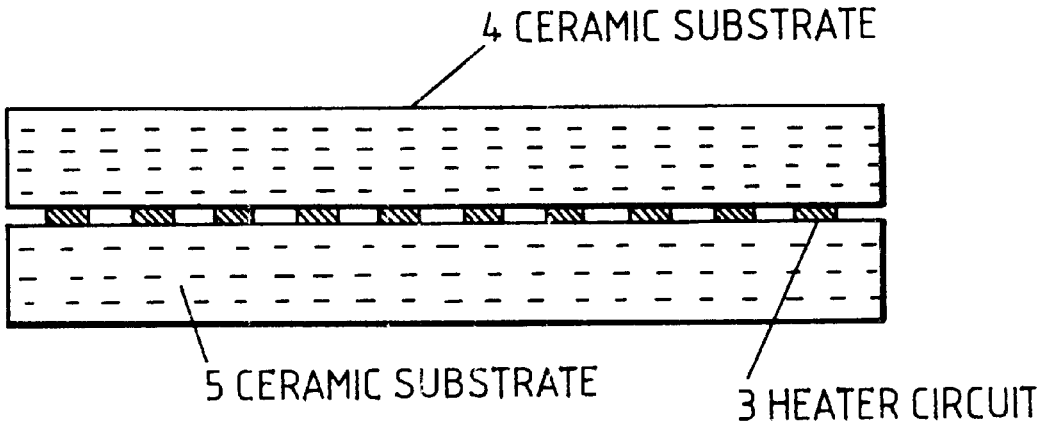
FIG. 6 is a cross sectional view taken along lines A—A of FIG. 5.
Figure 7:
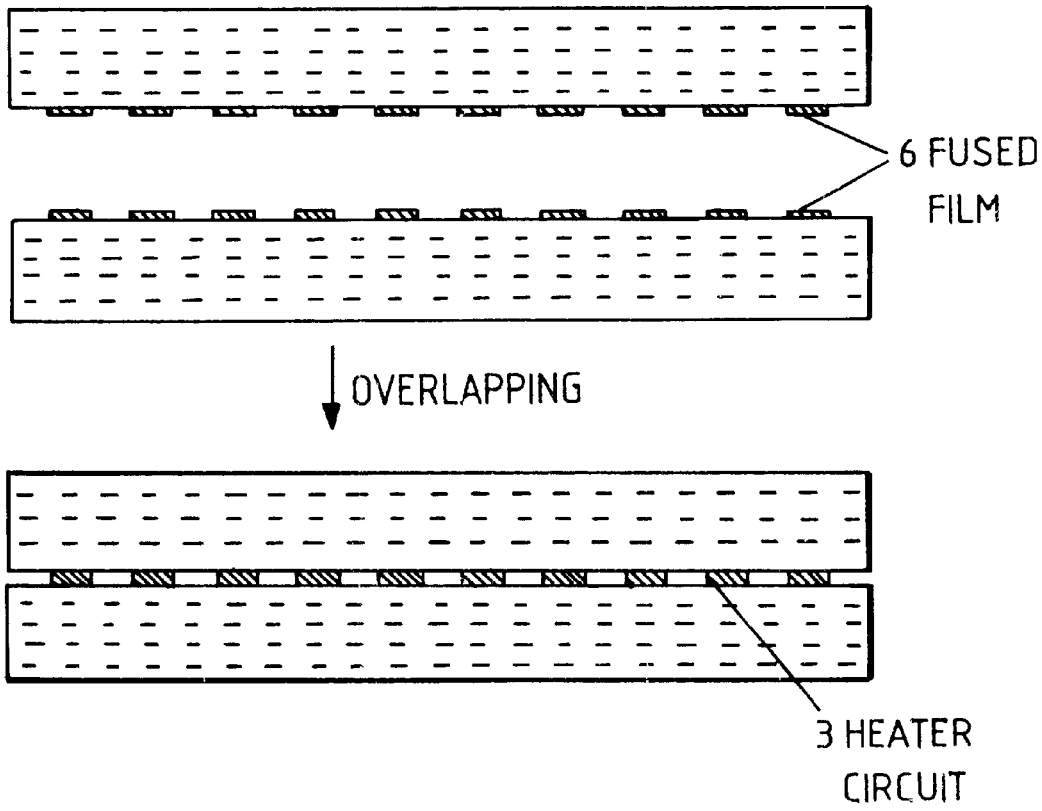
FIG. 7 is a schematic drawing showing one example of a production process for the structure shown in FIG. 6.
Figure 8:
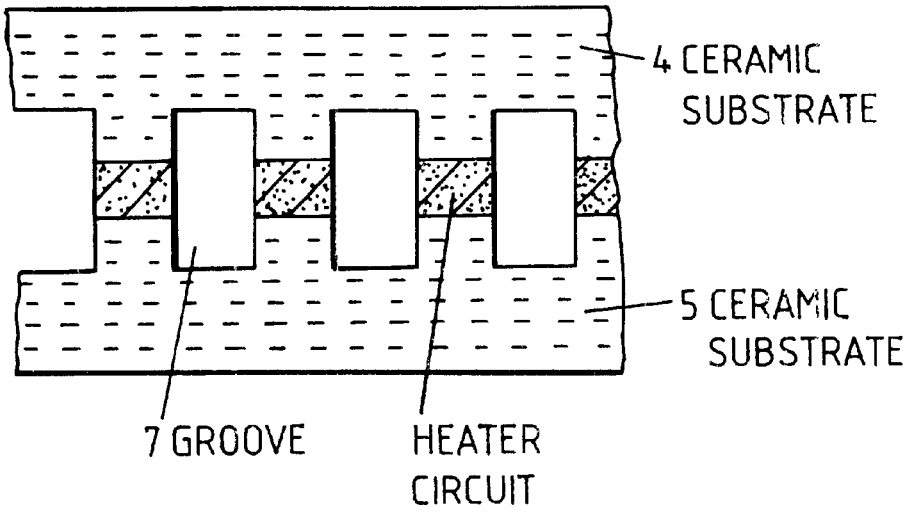
FIG. 8 is a schematic drawing for explaining a structure for preventing short-circuiting of a heater circuit.

FIG. 6 shows a cross sectional view taken along lines A—A of a structure that a heater circuit is interposed between two ceramic substrates. FIG. 7 shows an example of production process for the structure shown in FIG. 6. FIG. 8 is a schematic diagram showing a structure of preventing short-circuiting of a heater circuit.

In FIG. 6, the heater circuit 3 of the fused metal is interposed between the two ceramic substrates 4, 5 and fused thereto. The fused metal makes the heater circuit and also serves as a brazing material to hold the two ceramic substrates together at the same time.

The circuit can be formed, for example, in the following methods.

(1) One or both of the ceramic substrates are coated with a circuit pattern made of metallic powder prepared in the composition of the fused metal, with the two ceramic substrates being laminated, heated to melt and fused.

(2) One or both of the ceramic substrates are coated with a fused metal film made in the circuit pattern, with the two ceramic substrates being laminated, heated to melt and fused. The fused metal film is formed by sputtering, PVD, CVD or other process.

(3) The circuit pattern is formed by a method combining those of (1) and (2), namely through both the film forming and powder application, then the film is heated to be melted and fused.

(4) Fused metal film is formed on the joining surface of each ceramic substrate and then unnecessary portions of the film is removed through shot blast or other means thereby to have the desired circuit pattern left to remain. The two ceramic substrates having the circuit patterns formed thereon are put one another with accurate alignment, and then the ceramic substrates are heated to be melted again and fused.

Another method as shown in FIG. 7 may also be employed wherein a metal is fused to the joining surface of each ceramic substrate to form a fused film 6, then unnecessary portions of the film is removed through shot blast, etching or other means to form the circuit pattern, and thereafter the ceramic substrates are put one on another and heated (or heated under pressure as required), thereby to sinter at a temperature lower than the melting point.

In a structure wherein the heater circuit is interposed between two ceramic substrates as shown in FIG. 6 and FIG. 7, there is a possibility of the fused metal penetrating laterally to cause short-circuiting. The thicker the metal film, the higher the possibility of short-circuiting to occur.

Short-circuiting can be prevented by forming a groove 7 between adjacent portions of the circuit thereby increasing the space between the ceramic substrates as shown in FIG. 8.

In case the heater circuit is interposed between two ceramic substrates, there remains a gap corresponding to the thickness of the heater circuit of the fused metal between the two ceramic substrates.

Existence of the gap may allow foreign matter to enter, thus resulting in short-circuiting depending on the application. Thus sealing of the gap at the edges may be important.

An effective method of edge sealing is to enclose the ceramic substrate on the edges thereof with a belt of fused metal to form a closed circuit 8, and fusing the closed circuit 8 to the edges of both ceramic substrates.

Fusing of the sealing closed circuit 8 is carried out at the same time as the heater circuit is fused, by using the same metal as the fusing metal of the heater circuit or by using a material which can be fused under the same condition as that of the fusing metal of the heater circuit.

Other methods of sealing include impregnating a ceramic adhesive agent and solidifying it and fusing with glass.

Figure 9:
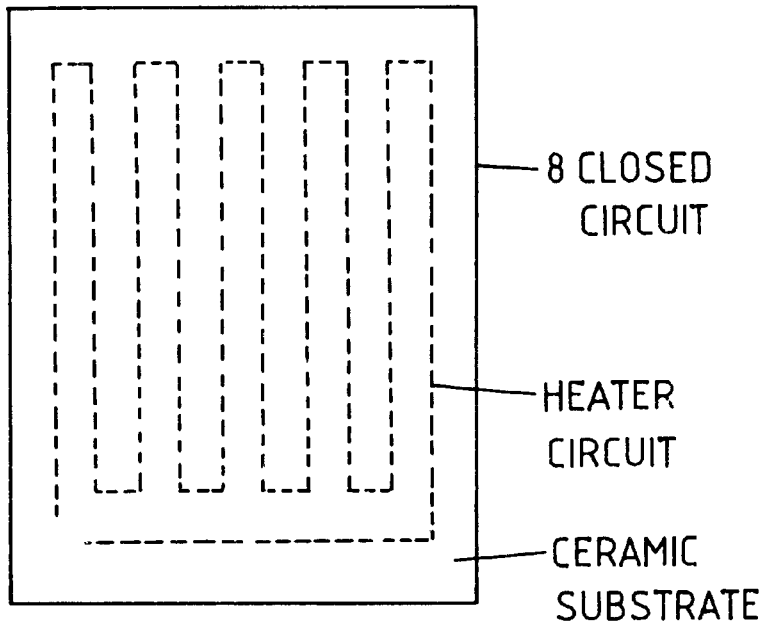
FIG. 9 is a schematic drawing for explaining a sealing structure at the end face of a ceramic.

[Explanation of FIG. 9]

FIG. 9 is a schematic diagram showing a structure obtained by applying the fusing metal of the heater circuit on the heater circuit forming surface of one or both of the two ceramic substrates, applying the pattern of the metal closed circuit 8 made of the same metal as the fusing metal of the heater circuit or a material which can be fused under the same condition as that of the fusing metal of the heater circuit at the same time, and putting them one on another and heating the assembly to fuse at the same time. The heater circuit and the closed circuit 8 are hidden in the ceramic structure and are therefore indicated with dashed lines. The heater circuit and the closed circuit are electrically insulated from each other.

For the connection of terminals of the heater circuit and the external electric source, the following structure is effective. (1) A metallic terminal having linear expansion coefficient similar to the linear expansion coefficient of the ceramic substrate is brazed to connect the metallic terminal and the lead wire. The structures are shown in FIG. 10 and FIG. 11.

Figure 10:
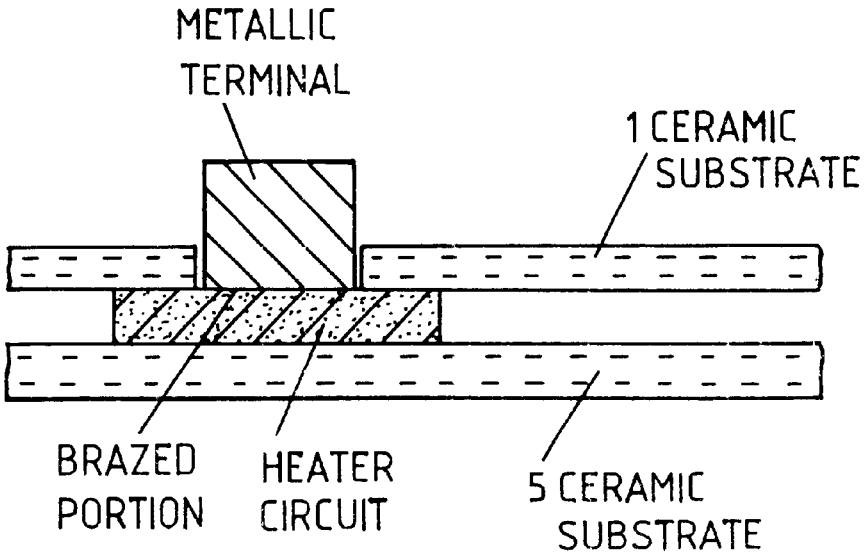
FIG. 10 is a schematic drawing for explaining a structure with a terminal connected to the end of a heater circuit.
Figure 11:
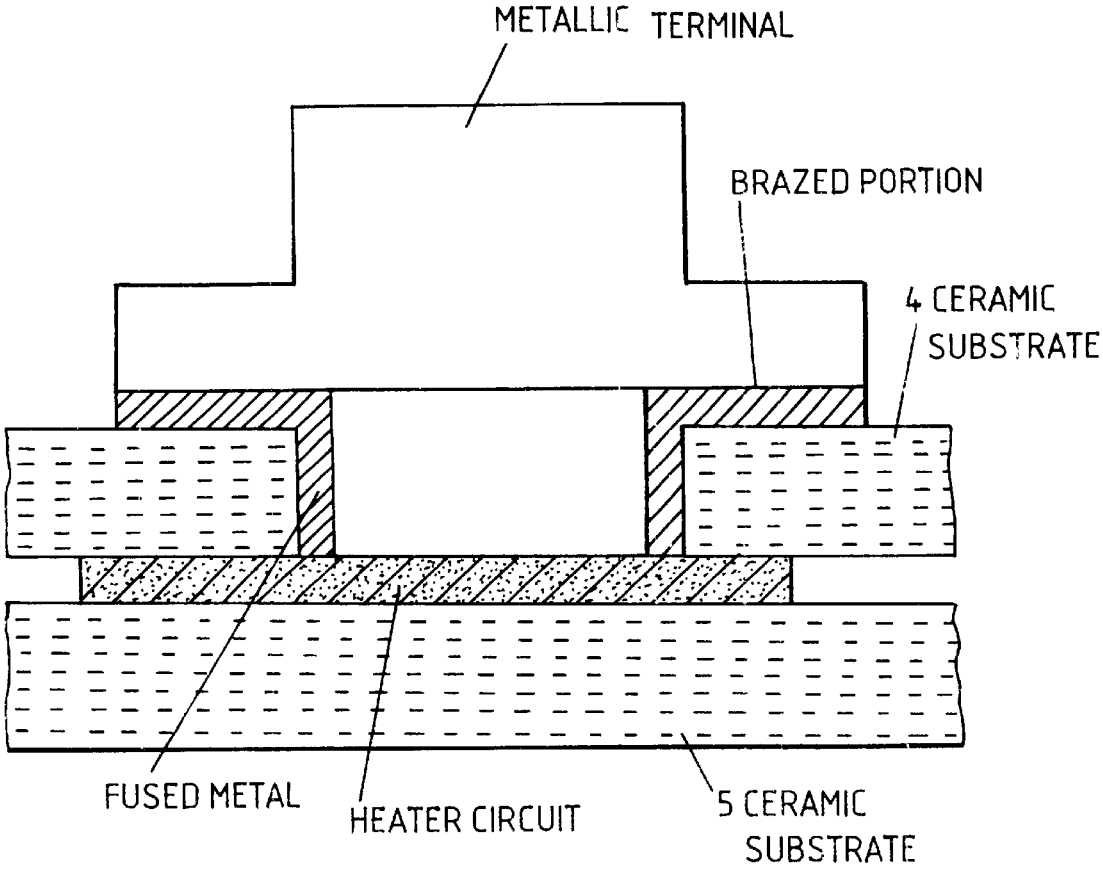
FIG. 11 is a schematic drawing for explaining a structure with a terminal connected to the end of a heater circuit.

FIG. 10 shows a structure wherein the metallic terminal is directly brazed to the circuit terminal. FIG. 11 shows a structure wherein the circuit terminal is drawn out to the outer surface of the ceramic substrate and brazed on the outer surface. That is, two holes (in the case of single-phase power supply) or three holes (in the case of three-phase power supply) are made in one of the ceramic substrates for leading out the circuit, then after leading out the circuit by metallizing the fused metal along the inner surface of the holes, the terminals are brazed at the mouth of the hole. Alternatively, lead wires made of metals (Mo, W, etc.) having similar linear expansion coefficients are inserted in the lead-out holes with the space between the lead wire and the hole being filled with a brazing material, thereby directly brazing with the circuit terminals. The holes may also be made smaller in diameter and filled with the fused metal, with the terminal being led out to the outside and brazed with the led wires.

Figure 12:
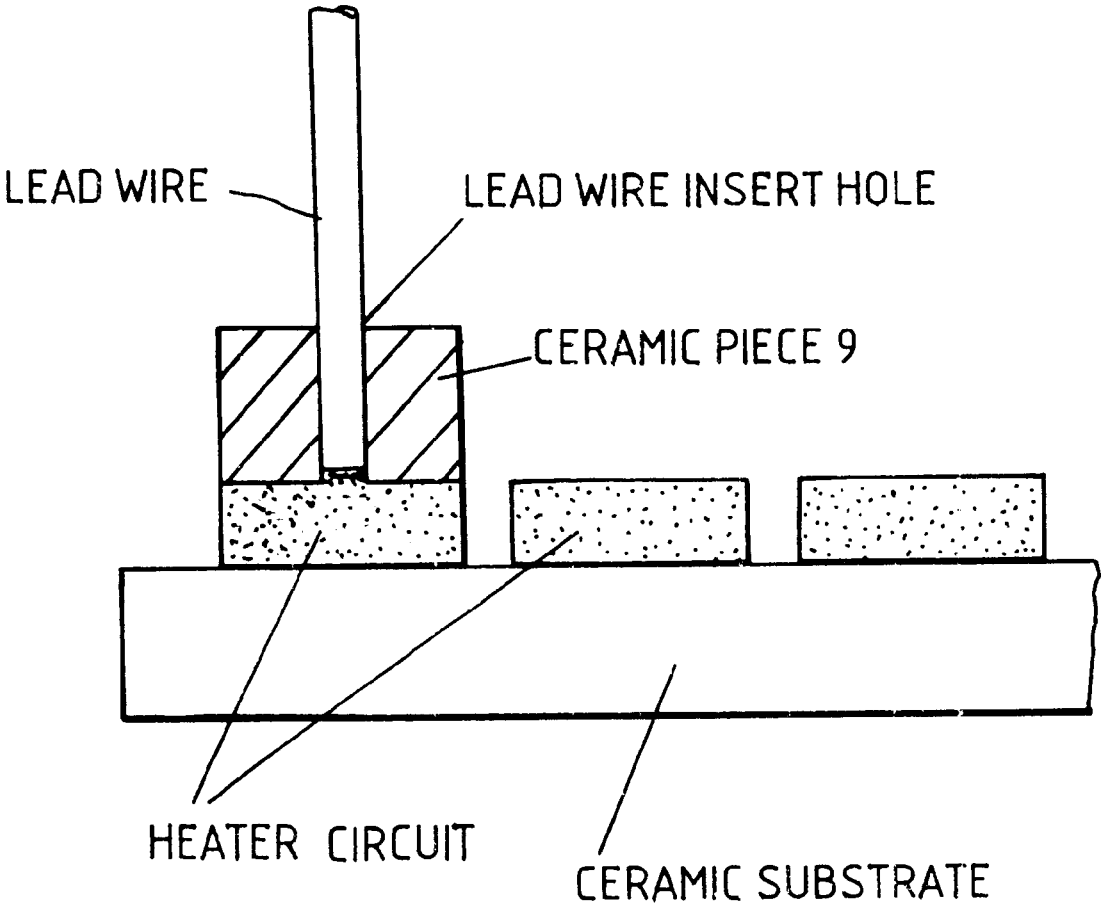
FIG. 12 is a schematic drawing for explaining a structure with a lead wire connected to the end of a heater circuit.

In the single-side fused structure, such a method may also be employed as a ribbon terminal made of a metal having linear expansion coefficient similar to that of the ceramic substrate is brazed to the circuit terminal and the ribbon terminal and the external lead wire are electrically connected. Such a method may also be employed as a small ceramic piece 9 is bonded to the heater circuit as shown in FIG. 12, with a lead wire being inserted into the small hole 9 and brazed to fix.

Brazing of the terminal may be done by using the fused metal at the same time when forming the circuit, or may be done by using a high-temperature braze, Ni braze or the like having high oxidation resistance after forming the circuit.

When aluminum nitride ceramic, silicon nitride ceramic or silicon carbide ceramic is used as the ceramic substrate, a composite material made by impregnating a porous material made of Mo, W, aluminum nitride ceramic, silicon nitride ceramic or silicon carbide ceramic with the fused metal can be preferably used for the terminal. Structure of the metallic terminal and the lead wire may be selected from solid material, bundle wires, laminated foils, woven fabric and other structures.

Now the electrostatic chuck of the present invention will be described below.

The heating mechanism of the present invention is a ceramic heater comprising two electrically ceramic insulating substrates having equal or near equal linear expansion coefficient and a film interposed between the two substrates and made of an electric-heating material which can be fused with with the two substrates.

The electrostatic chuck of the present invention has a ceramic heater bonded integrally with the bottom face of the chucking mechanism thereof, and is capable of quickly heating the chucked object such as semiconductor substrate. When a cooling mechanism is further coupled integrally with the bottom face of the heating mechanism, cooling function is added, thereby making it possible to accurately control the temperature by using both the heating and cooling functions.

When coupling the heating mechanism and cooling mechanism integrally with the electrostatically chucking mechanism, it is indispensable to bond them in the order of the cooling mechanism, the heating mechanism and the electrostatically chucking mechanism.

When coupling in the reverse order, namely in the order of the heating mechanism, cooling mechanism and the electrostaticaly chucking mechanism, the cooling mechanism is disposed between the heating mechanism and the electrostatic chucking mechanism, and a gap in the cooling medium of the cooling mechanism becomes a heat insulating layer which inhibits the transfer of heat from the heating mechanism to the electrostatically chucking mechanism, resulting in a lower rate of temperature rise during heating of the substrate. In the actual treatment, transition periods during which the temperature changes from low to high and high to low levels are loss time of which increase results in a decrease in the productivity. Reversing the order of coupling increases the loss time during heating and results in significant decrease in the productivity.

The expression of "integral coupling" of the electrostatically chucking mechanism, the cooling mechanism and the heating mechanism has the following meaning.

(1) Coupling by Metallurgical Means

Corresponds to brazing of the electrostatic chucking mechanism, the ceramic heater and the cooling mechanism.

(2) Coupling by Lamination of Films

Coupling to the substrate by laminating films through film forming process such as thermal spraying, PVD, CVD and sputtering. Corresponds to the formation of dielectric ceramic film on the ceramic heater. That is, a metal electrode film is formed on the ceramic heater and the dielectric ceramic film is further formed thereon, or a metal electrode plate is bonded to the ceramic heater and the dielectric ceramic film is formed on the plate.

(3) Coupling by Sintering or Firing

Coupling by sintering or firing of metal and ceramic or ceramic and ceramic which is out of the scope of metallurgical bonding which encompasses inter-metal bonding.

[Electrostatically Chucking Mechanism Segments]

The electrostatically chucking mechanism segment of the present invention refers to an electrostatically chucking mechanism portion of an electrostatic chuck.

The electrostatic chucking mechanism segment consists mainly of a dielectric ceramic and an electrostatic induction electrode formed on the back of this ceramic. A single-pole electrostatic chuck consists mainly of the dielectric ceramic and the electrostatic induction electrode formed on the back of the ceramic. A double-pole electrostatic chuck consists mainly of the dielectric ceramic, the electrostatic induction electrode formed on the back of the ceramic and a ceramic insulator plate which backs up the electrode on the back side thereof.

The dielectric ceramic may be made by sintering a dielectric ceramic film formed by thermal spray, sputtering, CVD or other thin film forming process. The dielectric ceramic is not limited to ceramic materials having particularly high dielectric constants. Taking notice of the fact that attracting force increases as the thickness is decreased even with an ordinary electric insulating ceramic material, the present invention includes ceramic materials, of which dielectric constants are not particularly high, in the category of dielectric ceramics. Thus the dielectric ceramics include ceramic insulators such as silicon nitride, aluminum nitride, alumina, sapphire, silicon carbide, film of diamond and CBN as well as ceramics having high dielectric constants such as aluminum titante, barium titanate.

In order to prevent deformation from taking place during bonding, the dielectric ceramic is preferably made of the same ceramic material as the ceramic heater or one having linear expansion coefficient equal or nearly equal to that of the ceramic heater. That is, when the ceramic heater is made of a system of aluminum nitride, the dielectric ceramic is preferably made of a system of aluminum nitride ceramic or one having linear expansion coefficient equal or near equal to that of the ceramic heater. In case an ordinary electric insulating ceramic material, of which dielectric constant is not particularly high (for example aluminum nitride) , is used for the dielectric ceramic, it is effective in increasing the dielectric constant to add a ceramic material having a high dielectric constant (titania) in order to increase the dielectric constant.

While the heating mechanism (ceramic heater) is bonded to the back surface of the electrostatically chucking mechanism segment, ceramic surface of the heating mechanism, namely the ceramic heater, may also be used as an insulator on the back surface of the electrostatically chucking mechanism segment in the case of double-pole type.

Also when the heating mechanism (ceramic heater) is bonded to the back surface of the electrostatically chucking mechanism segment, a layer of a different material may be inserted in the bonding surface for the purpose of stress buffering. The electrostatically chucking mechanism segment of the present invention includes such a layer inserted.

[Cooling Mechanism]

The substrate is provided with a cooling medium circulating path through which a liquid or gas cooling medium is circulated for the purpose of cooling.

The circulation path is made by making a groove in the substrate, embedding a pipe in the substrate, mounting a partition plate in a spiral structure with both sides covered with plates bonded thereto form a spiral circulation path, casting or welding a metal structure having tubular path formed therein, sintering a ceramic structure having tubular path formed therein, or other method.

The substrate material wherein the circulation path is formed may be a metal having high thermal conductivity, a ceramic material or a composite of metal and ceramic. A metal-ceramic composite material has such an advantage as decreasing the residual stress in the joint of bonding because the linear expansion coefficient can be controlled by changing the composition. It is also effective in relieving the residual stress to insert a layer of a different material in the bonding surface when bonding the ceramic heater and the cooling mechanism.

(EXAMPLE)

The following Examples further illustrate the present invention in detail.

Example 1

(Double-side Fusing Type)

Ceramic Substrate

Four materials of aluminum nitride, silicon nitride, silicon carbide and alumina are used. The silicon carbide has an electrical resistance of $10^{11}$ ohm.cm.

Substrate Dimension

A plate of 10×30×0.6 mm

Fused Metal

Figure 13:
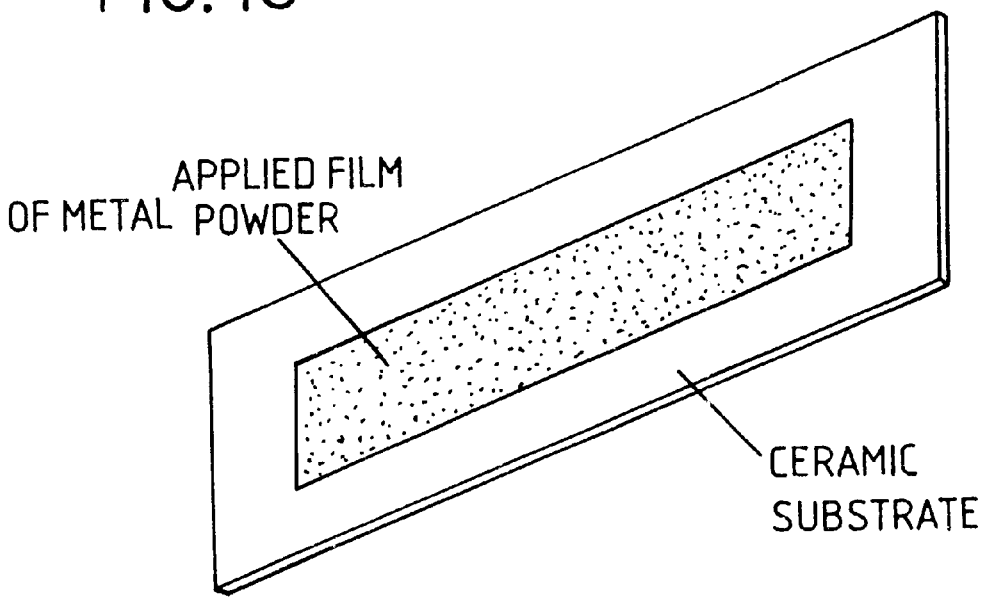
FIG. 13 is a schematic drawing for explaining the Example of an electric heating element of the present invention.
Figure 14:
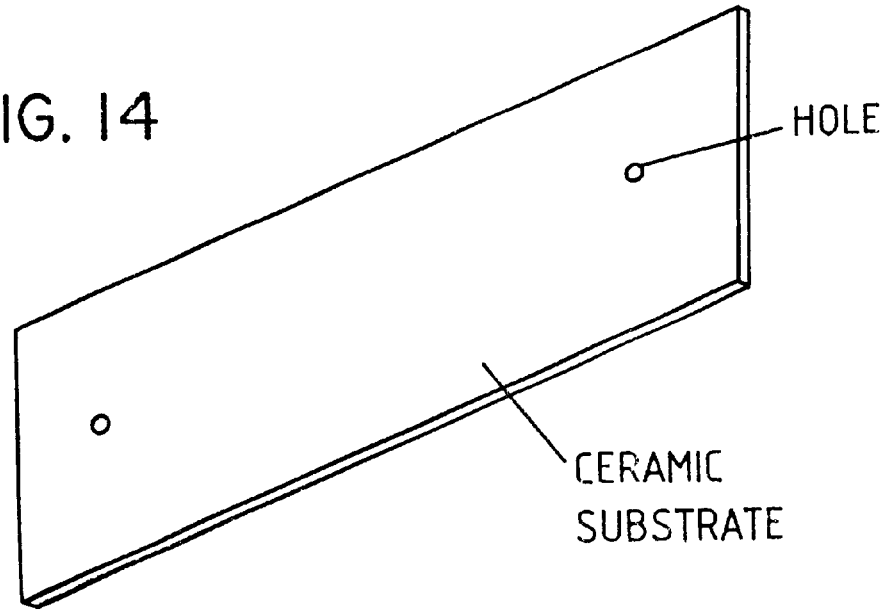
FIG. 14 is a schematic drawing for explaining the Example of an electric heating element of the present invention.
Figure 15:
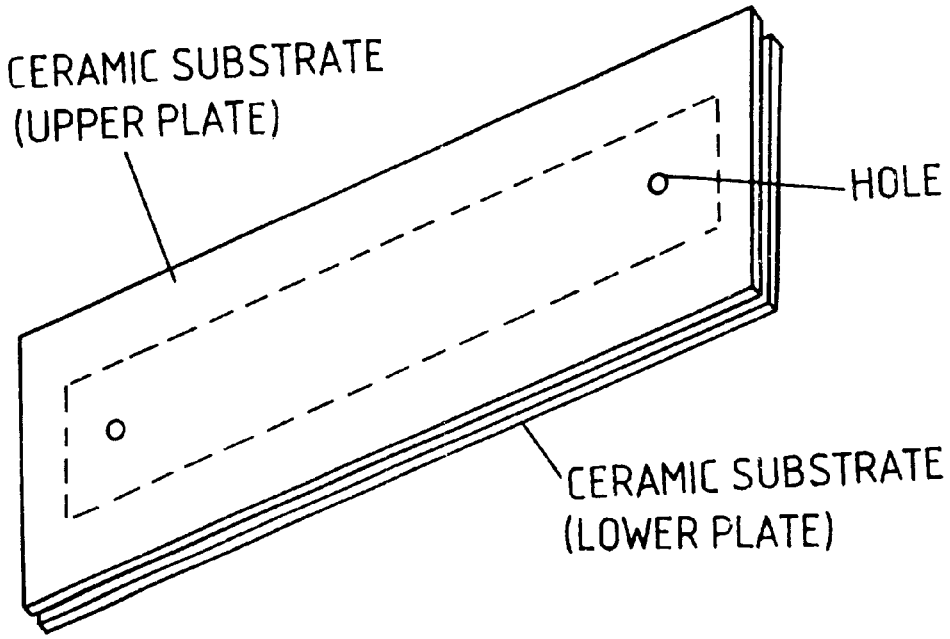
FIG. 15 is a schematic drawing for explaining the Example of the present invention.

The above-mentioned substrate made of aluminum nitride, silicon nitride, silicon carbide or alumina is coated with a paste of metallic powder having the following composition (shown in Table 1) mixed with ethanol solution of polyvinyl alcohol, in an area 2 mm wide and 22 mm long as shown in FIG. 13. This is laminated with a ceramic substrate having holes (1 mm in diameter) on both ends as shown in FIG. 14, with the assembly being dried and then heated to melt and fuse as shown in FIG. 15. The holes are separated 20 mm apart.

As the Si material, powder made by grinding a semiconductor substrate and powder of 99.999% purity (Al, Mg, Ca, Na<=1 ppm) were used. The powder made by grinding a semiconductor substrate is p-type Si doped with B.

The p-type Si doped with B has a resistance of 0.0 to 0.1 ohmcm. A sample using the p-type Si doped with B is denoted as p-type Si, while a sample not denoted is powder of 99.999% purity.

Heating was carried out in vacuum ($5\times10^{-5}$ Torr) and in argon atmosphere. Fused metal having the three microstructures of (2), (3) and (4) were used, namely the region where silicide is formed, the region where a mixture of silicide and Si is formed and the region where Si alone is formed.

Substrate

ALN is aluminum nitride.

SiC is silicon carbide.

SiN is Silicon nitride.

$Al_2O_3$ is high-purity alumina.

Argon atmosphere for No.1 and No.18, vacuum for others. Electrical resistance was measured with resistance measuring probes inserted into two holes shown in FIG. 15.

Example 2

(Heating Test)

The sample of Example 1 was heat-tested with an alternate voltage applied. A cycle of heating up to 500 C. in five minutes and then leaving to cool down to the normal temperature was repeated 100 times. None of the samples showed peel-off or crack of the heater.

Then oxidation resistance of the fused metal was tested. The sample of Example 1 was heated at 1000 C. for five hours. No change in electrical resistance due to oxidation of the fused film was observed.

Example 3

(Comparison of Films for Uniform Fusibility)

A heater having a heater circuit fused to one side of a ceramic substrate (single-side fused structure) and a heater having a heater circuit fused to two ceramic substrates interposing the heater circuit (double-side fused structure)

TABLE 1

| No. | Powder cmpstn | Substrate | Fusing temp. C. | Microstructure | Film thickness (micron) |
|---|---|---|---|---|---|
| 1 | Si | ALN | 1460 | Si polycrystal | 100 micro meter |
| | Electrical resistance: 80 ohm p-type Si (B-doped) Argon atmosphere | | | | |
| 2 | Si-25% Ti | ALN | 1400 | Si + silicide | 50 micro meter |
| | Electrical resistance: 8.5 ohm | | | | |
| 3 | Si-50% Ti | ALN | 1520 | Silicide | 10 micro meter |
| | Electrical resistance: 2.0 ohm | | | | |
| 4 | Si-25% Cr | SiC | 1550 | Si + silicide | 45 micro meter |
| | Electrical resistance: 8.0 ohm | | | | |
| 5 | Si-10% Mo | SiC | 1460 | Si + silicide | 60 micro meter |
| | Electric resistance: 6.0 ohm | | | | |
| 6 | Si-37% Hf | ALN | 1400 | Si + silicide | 55 micro meter |
| | Electrical resistance: 6.0 ohm | | | | |
| 7 | Si-20% Zr | ALN | 1480 | Si + silicide | 60 micro meter |
| | Electrical resistance: 7.0 ohm | | | | |
| 8 | Si-18% Ti | SiN | 1430 | Si + silicide | 50 micro meter |
| | Electrical resistance: 20.0 ohm | | | | |

| No. | Powder cmpstn | Substrate | Fusing temp. C. | Film thickness (micron) |
|---|---|---|---|---|
| 9 | Si-6% Nb-4% Fe | SiC | 1480 | 20 micro meter |
| | Electrical resistance: 16.0 ohm | | Microstructure: S + silicide | |
| 10 | Si-18% Nb-12% NI | SiC | 1500 | 30 micro meter |
| | Electrical resistance: 13.0 ohm | | Microstructure: Si + silicide | |
| 11 | Si-15% Ta | ALN | 1450 | 70 micro meter |
| | Electrical resistance: 5.0 ohm | | Microstructure: Si + silicide | |
| 12 | Si-10% V | SiC | 1480 | 60 micro meter |
| | Electrical resistance: 7.0 ohm | | Microstructure: Si + silicide | |
| 13 | Si-15% Ti-10% Zr | ALN | 1450 | 50 micro meter |
| | Electrical resistance: 7.0 ohm | | Microstructure: Si + silicide | |
| 14 | Si-15% Y | SiC | 1480 | 60 micro meter |
| | Electrical resistance: 5.0 ohm | | Microstructure: Si + silicide | |
| 15 | Si-5% Cr-5% Ni | SiC | 1450 | 30 micro meter |
| | Electrical resistance: 11.0 ohm | | Microstructure: Si + silicide | |
| 16 | Si-10% Co | ALN | 1450 | 20 micro meter |
| | Electrical resistance: 15.0 ohm | | Microstructure: Si + silicide Argon atmosphere | |
| 17 | Si-50% Ti | $Al_2O_3$ | 1550 | 10 micro meter |
| | Electrical resistance: 1.8 ohm | | Microstructure: Silicide | |
| 18 | $(Mo_5Al_3)Si_2$ | $Al_2O_3$ | 1900 | 10 micro meter |
| | Electrical resistance: 0.8 ohm | | Argon atmosphere | |
| | Microstructure: Composite silicide | | | |

were compared for uniformity of thickness (convexo-concave, flatness), uniformity of width and surface property.

Ceramic substrate: Aluminum nitride substrate measuring 100×100×0.6 mm

Fused metal: Two components having different levels of wettability for the fused metal. High-purity Si (99.999%) and Si–25%Ti were selected and compared.

Figure 16:
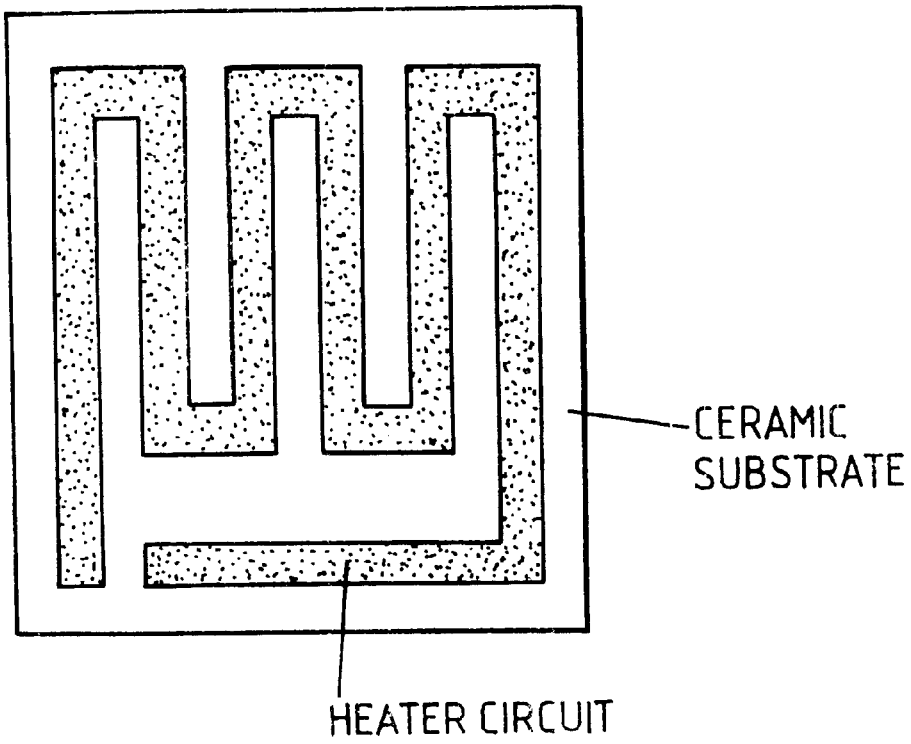
FIG. 16 is a schematic drawing for explaining the Example of the present invention.

Si powder (particle size under 325-mesh) mixed with ethanol solution of polyvinyl alcohol into a paste was printed to the surface of the aluminum nitride substrate in a circuit pattern shown in FIG. 16. Width of the circuit was 10 mm and space between adjacent circuits was 5 mm.

The single-side fused sample with the circuit printed on one side thereof was dried, and then heated and fused in vacuum ($5\times10^{-5}$ Torr).

The double-side fused sample with the circuit printed thereon comprising two identical ceramic plates aligned and laminated was dried, and then heated and fused in vacuum ($5\times10^{-5}$ Torr).

High-purity Si sample was heated to 1450 C. and fused. Si–25%Ti sample was heated to 1400 C. and fused.

Results

[Single-side Fused Sample]

Film of the high-purity Si sample swelled and resulted in uneven surface. Width of the circuit pattern decreased from the originally printed size.

Film of the Si-25%Ti was made almost flat free form convexo-concave portion. Width of the circuit pattern remained almost the same as the originally printed size.

It was observed that film flatness of the single-side backing sample differed with the wettability of the fused metal.

[Double-side Fused Sample]

In the case of the double-side fused sample fused between two ceramic substrates, because both the high-purity Si sample and the Si–25%Ti sample were interposed between ceramic plates on both sides, the films were completely fused flatly without swelling. Width of the circuit pattern remained almost the same as the originally printed size.

It was observed that a flat fused film was formed regardless of the difference in the wettability of the fused metal in the case of double-side backing sample.

It was verified that the double-side fusing type was better than the single-side fusing type in the film flatness, namely uniformity of thickness, and consistency of the circuit width.

Example 4

(Comparison of Fused Structure and Deformation After Heating)

Ceramic Substrate

Aluminum nitride

Substrate Dimension

A plate measuring 10×110×0.6 mm

Fused Metal

Si–25%Ti

Si Material

Purity 99.999% (Al, Mg, Ca, Na<=1 ppm)

The above-mentioned ceramic substrate (lower plate) was coated over the entire surface of one side thereof with a paste of metallic powder prepared to the composition shown above and mixed with ethanol solution of polyvinyl alcohol. After drying, an identical ceramic plate (upper plate) having holes 1 mm in diameter on both end portions (distance between holes: 100 mm) was placed thereon, and heated to fuse at 1400 C. in vacuum ($5\times10^{-5}$Torr) so that the two ceramic plates fuse with each other.

For comparison, such a single-side fused sample was made as the ceramic plate was coated with the paste over the entire surface of one side thereof, which was then heated to fuse at 1400 C. in vacuum ($5\times X10^{-5}$ Torr).

[Results]

After fusing two types of sample (double-side fused sample, single-side fused sample), an alternate voltage was applied across both ends to raise the temperature to 500 C. in five minutes.

The single-side fused sample experienced warping of 200 micro meter while the double-side backing sample showed no significant warp.

It was found that the double-side fused structure has significant effect of preventing deformation from occurring during heating, compared to the single-side fused sample.

Example 5

Ceramic Substrate

Three materials of aluminum nitride, silicon carbide and silicon nitride were used. The silicon carbide used has electrical resistance of $10^{11}$ ohm.cm.

Substrate Dimension

A plate measuring 10×30×0.6 mm

Fused Metal

Figure 4:
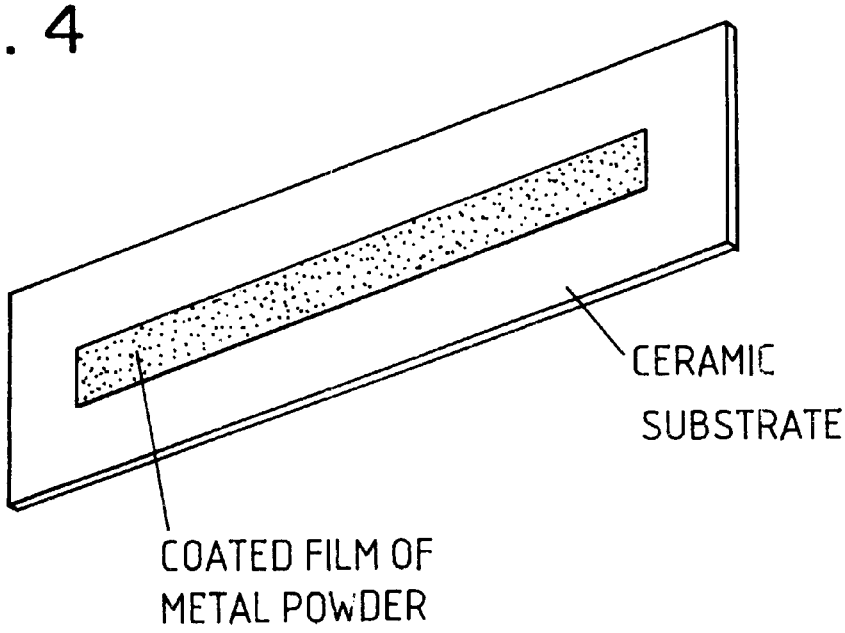
FIG. 4 is a schematic drawing for explaining the Example of the electric heating element of the present invention.

The above ceramic substrates were coated with a paste of metallic powder having the composition shown below (Table 2) mixed with ethanol solution of polyvinyl alcohol, in an area 2 mm wide and 22 mm long, as shown in FIG. 4, to form a thin film. This was dried and then heated to melt and fuse.

As the Si material, powder made by grinding a semiconductor substrate and powder of 99.999% purity were used. The powder made by grinding a semiconductor substrate is p-type Si doped with B.

The p-type Si doped with B has a resistance of 0.0 to 0.1 ohm.cm. A sample using the p-type Si doped with B is denoted as p-type Si, while a sample not denoted is powder of 99.999% purity.

Heating was carried out in vacuum ($5\times10^{-5}$ Torr) and in argon atmosphere.

Fused metal having the three microstructures of (2), (3) and (4) were used, namely the region of forming silicide, the region where silicide and Si coexist and the region of single Si structure. Electrical resistance was measured at a distance of 20 mm.

TABLE 2

| No. | Powder cmpstn | Substrate | Fusing temp C. | Microstructure | Film thickness (micron) |
|---|---|---|---|---|---|
| 1 | S | ALN | 1460 | Si polycrystal | 50 micro meter |
| | Electrical resistance: 200 ohm p-type Si (B-doped) Argon atmosphere | | | | |
| 2 | Si-25% Ti | ALN | 1400 | Si + silicide | 50 micro meter |
| | Electrical resistance: 7.0 ohm | | | | |
| 3 | Si-50% Ti | ALN | 1520 | Slicide | 20 micro meter |
| | Electrical resistance: 1.5 ohm Argon atmosphere | | | | |

TABLE 2-continued

| No. | Powder cmpstn | Substrate | Fusing temp C. | Film thickness (micron) |
|---|---|---|---|---|
| 4 | Si-25% Cr-1% Ti | ALN | 1550 | 40 micro meter |
| | Electrical resistance: 10 ohm | | Microstructure: Si + silicide | |
| 5 | Si-10% Mo-O.5% Ti | SiN | 1460 | 50 micro meter |
| | Electrical resistance: 7.5 ohm | | Microstructure: Si + silicide | |
| 6 | Si-37% Hf | ALN | 1400 | 70 micro meter |
| | Electrical resistance: 6.0 ohm | | Microstructure: Si + silicide | |
| 7 | Si-20% Zr | ALN | 1480 | 60 micro meter |
| | Electrical resistance: 8.0 ohm | | Microstructure: Si + silicide | |
| 8 | Si-15% Ta | ALN | 1450 | 50 micro meter |
| | Electrical resistance: 6.0 ohm | | Microstructure: Si + silicide | |
| 9 | Si-10% V | SiC | 1480 | 80 micro meter |
| | Electrical resistance: 6.0 ohm | | Microstructure: Si + silicide | |
| 10 | Si-15% Ti-10% Zr | ALN | 1450 | 70 micro meter |
| | Electrical resistance: 8.0 ohin | | Microstructure: Si + silicide | |
| 11 | Si-15% Y | SiN | 1480 | 40 micro meter |
| | Electrical resistance: 6.0 ohm | | Microstructure: Si + silicide | |
| 12 | Si-5% Cr-5% Ni | SiC | 1450 | 50 micro meter |
| | Electrical resistance: 7.0 ohm | | Microstructure: Si + silicide | |
| 13 | Si-10% Co | ALN | 1450 | 60 micro meter |
| | Electrical resistance: 6.0 ohm | | Microstructure: Si + silicide Argon atmosphere | |

Substrate

ALN is aluminum nitride. SiC is silicon carbide. SiN is silicon nitride. Argon atmosphere for No.1 No.3 and No.13, vacuum for others. Electrical resistance across 20 mm was measured.

Example 6

(Heating Test)

The sample of Example 5 was heat-tested with an alternate voltage applied.

A cycle of heating up to 500 C. in five minutes and then leaving to cool down to the normal temperature was repeated 100 times.

None of the samples showed peel-off or crack of the heater.

Then oxidation resistance of the fused metal was tested. The sample of the Example 5 was heated at 1000 C. for five hours.

No peel-off and change in electrical resistance due to oxidation of the fused film were observed.

Example 7

Ceramic Substrate

Aluminum nitride

Substrate Dimension

A plate of 10×25×0.6 mm

Fused Metal

Ti was sputtered on one side of the ceramic substrate (lower plate) to a thickness of 0.5 micro meter and Si was sputtered a thickness of 4 micro meter to the Ti layer in an area 2 mm wide and 22 mm long.

For the same ceramic plate (upper plate) having holes 1 mm in diameter on both ends (distance between holes: 20 mm) shown in FIG. 14, Ti was sputtered on one side thereof to a thickness of 0.5 micro meter and Si was sputtered on the Ti film to a thickness of 4 micro meter in an area 2 mm wide and 22 mm long.

The sputtered surfaces were put together and heated to fuse at 1400 C. in vacuum ($5\times10^{-5}$ Torr) so that the two ceramic plates fuse with each other as shown in FIG. 15.

[Results]

Electrical resistance, measured by inserting probes into the holes of 1 mm in diameter of the fused sample, was 10 ohm.

Then the sample was heat-tested.

A cycle of heating up to 500 C. in five minutes and then leaving to cool down to the normal temperature was repeated 100 times.

As a result, none of the two fused plates showed peel-off or crack.

Then oxidation resistance test was conducted by heating the sample at 1000 C. for ten hours.

The two fused plates showed no peel-off or crack. Also no change in electrical resistance of the fused film was observed.

Now preferred embodiments of the electrostatic chuck will be described below with reference to the accompanying drawings.

Figure 18:
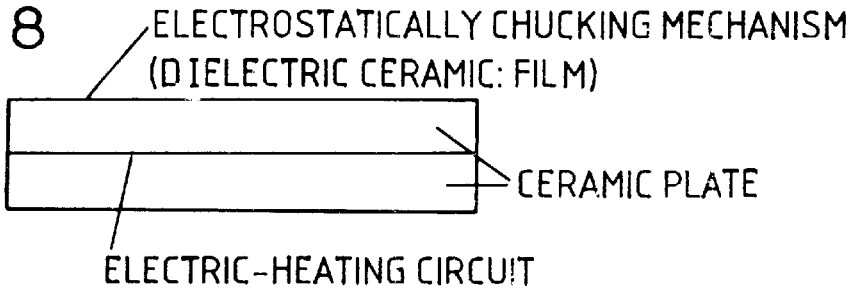
FIG. 18 is a schematic drawing for explaining a basic structure of an electrostatic chuck according to the present invention (a dielectric ceramic is a film).
Figure 19:
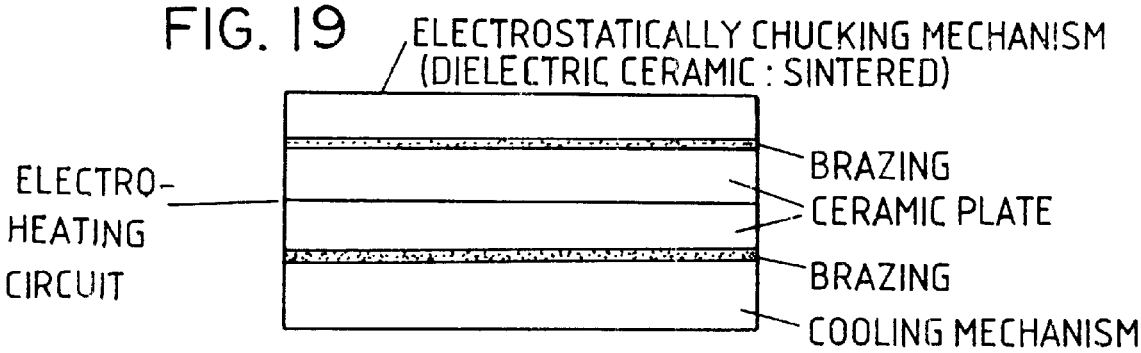
FIG. 19 is a schematic drawing for explaining a basic structure of an electrostatic chuck of the present invention (a cooling mechanism is coupled with the structure shown in FIG. 17).
Figure 20:
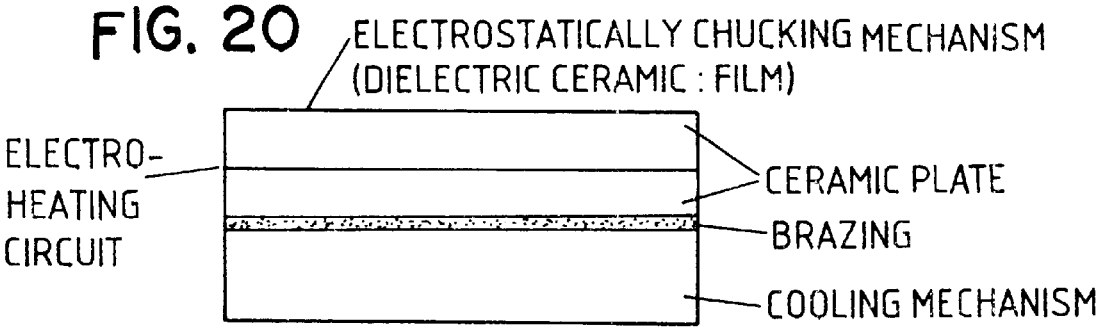
FIG. 20 is a schematic drawing for explaining a basic structure of an electrostatic chuck of the present invention (a cooling mechanism is coupled with the structure shown in FIG. 18).

The present invention can be basically divided into four structures. One is a structure of sintered dielectric ceramic (FIG. 17), one is a structure of dielectric film formed by thermal spray, CVD, PVD, sputtering or other film-forming technique (FIG. 18), and variations of the former two structures where cooling mechanisms are coupled with the heating mechanism (FIGS. 19, 20). FIGS. 17 to 20 show these structures.

Figure 17:
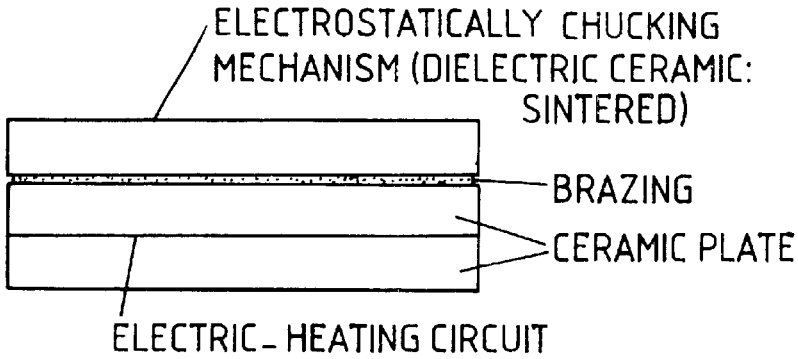
FIG. 17 is a schematic drawing for explaining a basic structure of an electrostatic chuck of the present invention (a dielectric ceramic is a sintered material).

FIG. 17 shows the sintered dielectric ceramic of the electrostatically chucking mechanism. FIG. 18 shows dielectric ceramic film of the electrostatically chucking mechanism. FIG. 19 shows the structure of FIG. 17 coupled with the cooling mechanism. FIG. 20 shows the structure of FIG. 18 coupled with the cooling mechanism.

The sintered dielectric ceramic is divided into two type of structures by the method of forming the electrode.

Figure 21:
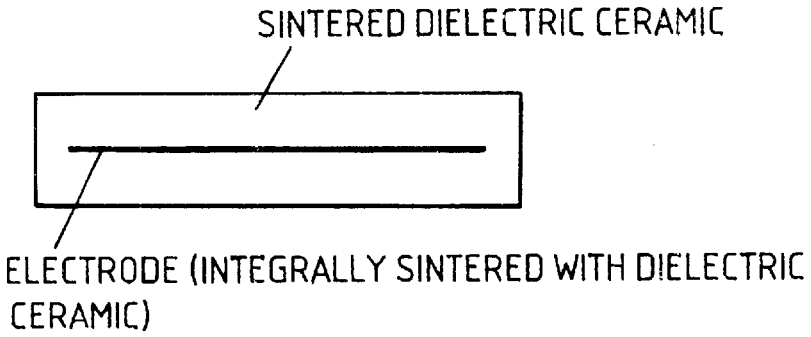
FIG. 21 is a schematic drawing for explaining a structure of an electrode in case where a dielectric ceramic is a sintered material.
Figure 22:
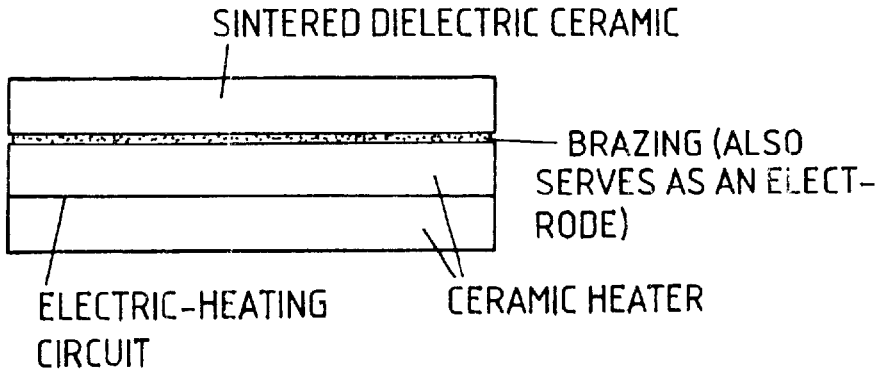
FIG. 22 is a schematic drawing for explaining a structure of an electrode in case where a dielectric ceramic is a sintered material.

One is a structure wherein the ceramic and electrode are integrally sintered as shown in FIG. 21. The electrode is enclosed by the ceramic. Another is a structure wherein the sintered body is brazed to the heater and the brazed layer also serves as the electrode as shown in FIG. 22.

Figure 23:
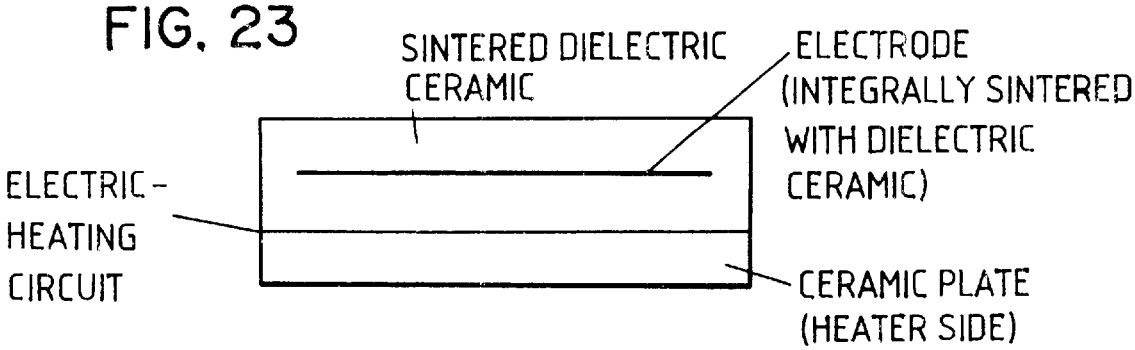
FIG. 23 is a schematic drawing for explaining a structure of an electrode in case where a dielectric ceramic is a sintered material.

In the case of the structure of FIG. 21, the electrically heat generating alloy of the ceramic heater may be directly fused to one side of the dielectric ceramic. Namely, the ceramic on one side of the heater may be replaced by one side of the dielectric ceramic as shown in FIG. 23.

The Examples will be described below.

Example 8

Figure 24:
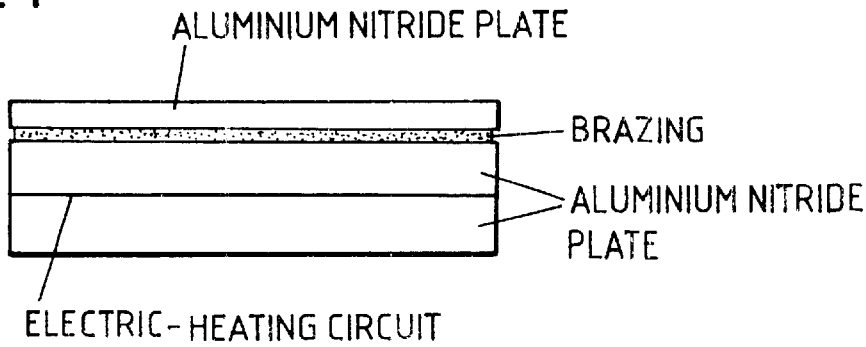
FIG. 24 is a schematic drawing for explaining a structure of an example of an electrostatic chuck of the present invention.

(Structure of FIG. 24)

Induction Chucking Mechanism

A disk (50 mm in diameter, 0.2 mm thick) made of aluminum nitride is used.

Heating Mechanism

Two disks (50 mm in diameter, 1 mm thick) made of aluminum nitride are used.

$Si+TiSi_2$ having a microstructure is used for electric-heating alloy. (Si–25%Ti alloy)

The electric-heating circuit pattern is printed with the Si–25%Ti alloy powder on one side each of the two aluminum nitride disks (50 mm in diameter, 1 mm thick). After preliminary sintering, the two disks were put together and heated to fuse at 1430 C. in vacuum to fuse. The electric-heating alloy film was 100 micro meter thick.

[Coupling]

Aluminum nitride disk of the induction chucking mechanism and the heater were coupled together by using the Si–25%Ti alloy similarly to the case of the electric-heating alloy. The coupling was carried out at the same time the heater was coupled.

Bonding metal as used as the electrode (single-pole).

[Test]

Electrostatic Chucking

A voltage of 700 V DC was applied across the electrode and a silicon wafer to attract the 2 inches silicon wafer to the surface of the dielectric ceramic.

Heating

The heater was powered to start heating from the normal temperature (20 C.), and the wafer surface was heated to 700 C. in 60 seconds.

Holding

Surface temperature of the silicon wafer was maintained at 700 C.±5 C. through ON/OFF control of the heater.

It was verified that the present invention is capable of quickly heating a silicon wafer and keeping the temperature constant.

Example 9

Figure 25:
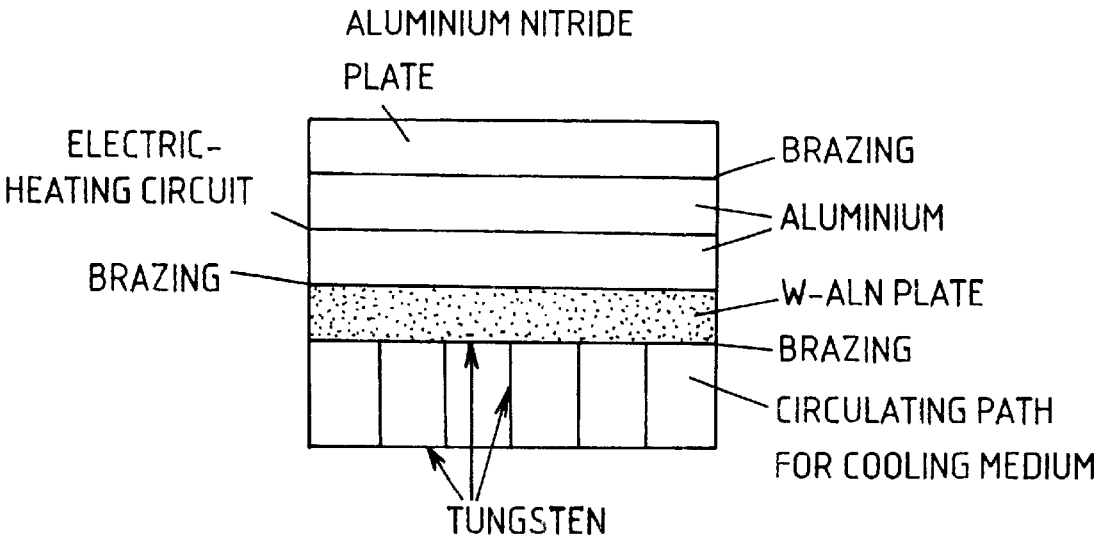
FIG. 25 is a schematic drawing for explaining a structure of an example of an electrostatic chuck of the present invention.

(Structure of FIG. 25)

Structure of Example 8 coupled with cooling mechanism

The induction chucking mechanism and the ceramic heater were produced in the same manner as that in Example 8. A Si–20%Zr alloy was used for the electrically heat generating alloy. Coupling was carried out at 1430 C. in vacuum. The thickness of the electric-heating alloy was 100 micro meter. For the electrode, the bonding metal layer was used as a single pole.

Structure of Cooling Mechanism

A tungsten strip 10 mm wide and 0.5 mm thick was wound in a spiral structure and was interposed between two tungsten disks 50 mm in diameter and 1 mm thick, with the end faces being silver-brazed with the tungsten disks. Water-cooling and air-cooling were employed.

[Coupling with the Cooling Mechanism]

The aluminum nitride heater and the cooling mechanism were directly brazed with Ti-added silver solder. When brazing, a composite sintered disk (50 mm in diameter, 1 mm thick) made of 50%W–50% aluminum nitride (volume %) was interposed between the aluminum nitride heater and the tungsten cooling mechanism for the purpose of stress relieving.

[Test]

Electrostatic Chucking

A voltage of 700 V DC was applied across the electrode and a silicon wafer to attract the 2 inches silicon wafer to the surface of the dielectric ceramic.

Heating

The heater was powered to start heating from 0 C., and the wafer surface was heated to 100 C. in 25 seconds.

Cooling

After turning off the heater, water cooling was started. The wafer surface was cooled down to 15 C. in 40 seconds.

Holding

Surface temperature of the silicon wafer was maintained at 50 C.±1 C. by combining heater operation and water-cooling.

It was verified that the present invention is capable of quickly heating and cooling a silicon wafer and keeping the temperature constant.

Example 10

Figure 26:
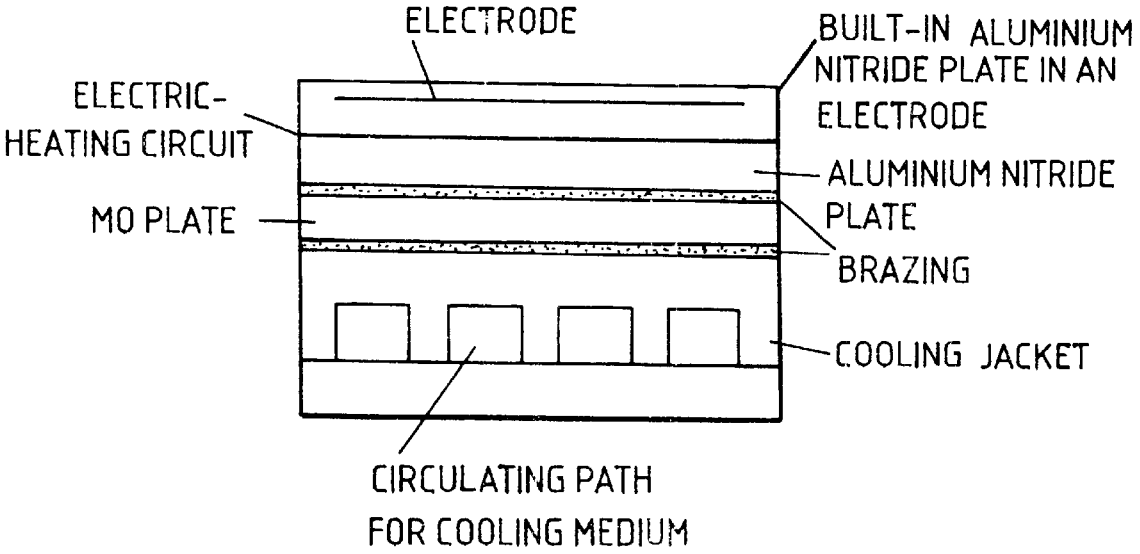
FIG. 26 is a schematic drawing for explaining a structure of an example of an electrostatic chuck of the present invention.

(Structure of FIG. 26)

The induction chucking mechanism: An aluminum nitride disk (50 mm in diameter, 2 mm thick) with a tungsten electrode film sintered therein at the same time was used.

Heating Mechanism

A heater circuit of electric-heating alloy (Si–15%Ti alloy) was printed on the aluminum nitride surface on the back (non-attracting side) of the aluminum nitride disk incorporating the electrode film therein. An aluminum nitride disk (50 mm in diameter, 1 mm thick) was put on the printed surface and heated to 1430 C. in vacuum so that the aluminum nitride disk incorporating the electrode film and the aluminum nitride disk were fused together. Thickness of the electrically heat generating alloy film was about 100 micro meter.

Structure of Cooling Mechanism

A grove of spiral structure for circulating cooling medium was machined on one side of an aluminum disk (50 mm in diameter and 25 mm thick) and covered with an aluminum disk (50 mm in diameter and 5 mm thick) which was brazed (with aluminum solder), to make a cooling jacket.

[Coupling with the Cooling Mechanism]

A Mo plate (50 mm in diameter and 1 mm thick) was interposed between the aluminum nitride heater and the cooling mechanism for stress relieving. The aluminum nitride heater and Mo, and Mo and the cooling mechanism were bonded with indium solder.

[Test]

Electrostatic chucking: A voltage of 700 V DC was applied across the electrode and a silicon wafer to attract the 2 inches silicon wafer to the surface of the dielectric ceramic.

Heating

The heater was powered to start heating from 0 C., and the wafer surface was heated to 100 C. in 25 seconds.

Cooling

After turning off the heater, circulation of water through the aluminum jacket was started. The wafer surface was cooled down to 15 C. in 50 seconds.

Holding

Surface temperature of the silicon wafer was maintained at 50 C.±1 C. by combining heater operation and water-cooling.

It was verified that the present invention is capable of quickly heating and cooling a silicon wafer and keeping the temperature constant.

INDUSTRIAL APPLICABILITY

As described above in detail, the electric heating element of the present invention comprises an electrically heat generating mechanism having a composite structure where an electric-heating material film made of silicide, Si or a mixture of silicide and Si is fused to the ceramic substrate. Thus, the present invention has a high industrial value by solving the problems that the electric-heating material is brittle and softens at a high temperature are mitigated, and provides a thin heater film for higher adhesion strength which prevents peel-off, higher oxidation resistance in air atmosphere, high durability to quick heating and high temperatures, long-term durability and simple construction for low-cost production.

The electrostatic chuck of the present invention is also capable of raising and lowering the surface temperature of a semiconductor substrate in a short period of time, and is capable of contributing greatly to the improvements of productivity and quality in plasma processing, film forming processes, etc.

What is claimed is:

1. An electric heating element having a structure comprising:

a preformed sintered electric insulating nitride or carbide ceramic substrate and a resistance heat-generating material film having a microstructure including a mixture of a silicide phase and a Si phase, said film being formed by melting, fusing and coagulating onto the surface of said preformed sintered electric insulating ceramic substrate to form a microstructure of metallurgically coagulated structure, wherein the linear expansion coefficient of said film is nearly or equally matched with the linear expansion coefficient of said substrate by selecting the kind of silicide and adjusting the ratio of silicide and Si.

2. The electric heating element according to claim 1, wherein the ceramic substrate is an aluminum nitride ceramic.

3. The electric heating element according to claim 1, wherein the ceramic substrate is a silicon nitride ceramic.

4. The electric heating element according to claim 1, wherein the ceramic substrate is a silicon carbide ceramic.

5. An electric heating element having a structure comprising:

two preformed sintered electric insulating nitride or carbide ceramic substrates and a resistance heat-generating material film having a microstructure including a mixture of a silicide phase and a Si phase, said film being interposed by melting, fusing and coagulating between said two preformed sintered electric insulating ceramic substrates to form a microstructure of metallurgically coagulated structure, wherein the linear expansion coefficient of said film is nearly or equally matched with the linear expansion coefficient of said substrate by selecting the kind of silicide and adjusting the ratio of silicide and Si.

6. The electric heating element according to claim 5, wherein the ceramic substrate is an aluminum nitride ceramic.

7. The electric heating element according to claim 5, wherein the ceramic substrate is a silicon nitride ceramic.

8. The electric heating element according to claim 5, wherein the ceramic substrate is a silicon carbide ceramic.

9. An electric heating element having a structure comprising:

a preformed sintered electric insulating nitride or carbide ceramic substrate;

a resistance heat-generating material film formed from a silicide-forming metal powder and a Si material, said film being a coagulated microstructure including a mixture of (i) a silicide formed by reaction of the Si material with said silicide-forming metal, and (ii) Si; and said film being formed by melting and fusing said Si material and said metal powder onto the surface of said preformed sintered electric ceramic substrate to form a mixture of the silicide and Si, and coagulating said mixture to form said coagulated microstructure including eutectic structure.

10. The electric heating element of claim 9, wherein the silicide-forming metal is selected from the group consisting of Cr, Mo, W, Fe, Ni, Co, B, P, Pt, Pd, Rh, Ir, Cu, Ag, V, Nb, Ta, Ti, Zr, Hf, Y, Mn, Ca, Mg, rare earth elements, Al, and mixtures thereof.

* * * * *